US010308386B2

(12) United States Patent
Koike et al.

(10) Patent No.: US 10,308,386 B2
(45) Date of Patent: Jun. 4, 2019

(54) MEDICINE DISPENSING APPARATUS

(75) Inventors: Naoki Koike, Toyonaka (JP); Takafumi Imai, Toyonaka (JP); Kazuaki Matsumura, Toyonaka (JP); Takuya Tsugui, Toyonaka (JP); Kazunori Tsukamoto, Toyonaka (JP)

(73) Assignee: YUYAMA MANUFACTURING Co., LTD., Toyonaka-shi (JP)

( * ) Notice: Subject to any disclaimer, the term of this patent is extended or adjusted under 35 U.S.C. 154(b) by 1023 days.

(21) Appl. No.: 13/485,831

(22) Filed: May 31, 2012

(65) Prior Publication Data

US 2012/0304596 A1 Dec. 6, 2012

Related U.S. Application Data

(60) Provisional application No. 61/519,955, filed on Jun. 2, 2011.

(51) Int. Cl.

| | |
|---|---|
| ***B65B 43/46*** | (2006.01) |
| ***B65B 43/52*** | (2006.01) |
| ***B65B 5/10*** | (2006.01) |
| ***G07F 17/00*** | (2006.01) |
| ***B65C 1/04*** | (2006.01) |

(52) U.S. Cl.

CPC ..... *B65B 43/46* (2013.01); *B65B 5/103* (2013.01); *B65B 43/52* (2013.01); *B65C 1/045* (2013.01); *B65C 1/047* (2013.01); *G07F 17/0092* (2013.01)

(58) Field of Classification Search

CPC ..... B65B 43/46; B65B 5/103; B65B 5/105
USPC ..... 53/136.1
See application file for complete search history.

(56) References Cited

U.S. PATENT DOCUMENTS

| | | | | |
|---|---|---|---|---|
| 5,798,020 | A * | 8/1998 | Coughlin | B65C 3/16 156/184 |
| 5,873,488 | A * | 2/1999 | Guerra | B25J 15/00 221/2 |
| 6,256,967 | B1 * | 7/2001 | Hebron | B65B 57/20 53/131.3 |
| 6,421,584 | B1 * | 7/2002 | Norberg | G07F 7/00 221/123 |
| 7,228,198 | B2 * | 6/2007 | Vollm | B65B 5/103 700/228 |

(Continued)

FOREIGN PATENT DOCUMENTS

| | | | | |
|---|---|---|---|---|
| JP | WO 2008156111 | A1 * | 12/2008 | B65B 5/103 |
| WO | 2012098857 | A1 | 7/2012 | |

*Primary Examiner* — Chelsea E Stinson
(74) *Attorney, Agent, or Firm* — Masuvalley & Partners

(57) ABSTRACT

A medicine dispensing apparatus fills a vial having a polygonal cross-sectional shape with medicines to dispense the medicines. The apparatus contains a stocker, a first vial transporting unit, a vial orienting unit, a labeling unit, a second vial transporting unit, a medicine filling unit, and a vial discharging window. The stocker stores the vial. The first vial transporting unit transports the vial from the stocker to the labeling unit. The vial orienting unit adjusts an orientation of the vial. The labeling unit labels the vial. The second vial transporting unit transports the vial from the labeling unit to the medicine filling unit. The medicine filling unit fills the vial with the medicines. The second vial transporting unit further transports the vial from the medicine filling unit to the vial discharging window, where the vial is discharged through the vial discharging window.

12 Claims, 22 Drawing Sheets

(56) References Cited

U.S. PATENT DOCUMENTS

| | | | | |
|---|---|---|---|---|
| 8,403,010 | B2 * | 3/2013 | Taniguchi | B65B 5/103 141/171 |
| 8,434,286 | B2 * | 5/2013 | Yuyama | B65B 5/103 294/902 |
| 8,434,641 | B2 * | 5/2013 | Coughlin | G07F 11/16 221/174 |
| 2006/0277269 | A1 * | 12/2006 | Dent | G06Q 50/24 709/217 |
| 2010/0230004 | A1 | 9/2010 | Taniguchi et al. | |
| 2011/0178634 | A1 | 7/2011 | Yuyama et al. | |
| 2011/0305545 | A1 * | 12/2011 | Davis | G07F 11/165 414/225.01 |
| 2012/0031043 | A1 | 2/2012 | Yuyama et al. | |
| 2012/0042609 | A1 | 2/2012 | Inoue et al. | |

* cited by examiner

MEDICINE DISPENSING APPARATUS

RELATED APPLICATIONS

This application claims the benefit of and is a non-provisional of U.S. Provisional Application Ser. No. 61/519,955 filed on Jun. 2, 2011, which is hereby expressly incorporated by reference in its entirety for all purposes.

TECHNICAL FIELD

The present invention relates to a medicine dispensing apparatus, which fills a vial with medicines based on a prescription datum.

BACKGROUND OF THE INVENTION

Behind the counter of a drug store and hospital pharmacy, medicine dispensing machines are essential tools for the pharmacists to efficiently fill the vials with the prescribed medicines so that they can quickly deliver the medicines to the customers and patients. Latest machines not only fill the vials with the medicines including tablets, capsules and powders but also label the vials to notify the pharmacist and patient useful information such as who the vial is for and what medicine the vial contains. Now, there is a demand from some users that they want to print more information on the labels.

One way to do so is to make the font size smaller. However, many patients are elderly people. These people often have presbyopia and feel difficult to read small letters. Therefore, making the font size smaller is not a good idea. Other ways are necessary to print more information on the labels.

One good way to print more information on the label is to make the label larger or to increase the number of labels put on the vial. However, since the label is usually pasted on the lateral surface of the vial, the total width of the labels cannot be larger than the circumference of the vial. Traditionally, the shape of the vials has been cylindrical. In other words, the transverse cross-sectional shape of the vials has been circular. In this case, the maximum width of the label that can be pasted is determined only by the diameter of the vial.

SUMMARY OF THE INVENTION

The inventors of the present invention came up with an idea that if the transverse cross-sectional shape of the vial was made polygonal, the area of the lateral surface of the vial would increase without changing the volume of the vial much. Therefore, the inventors of the present invention decided to employ the vial having a polygonal cross-sectional shape for the medicine dispensing apparatus.

However, one problem arose while designing the medicine dispensing apparatus. Since the cylindrical vial has an infinite number of symmetry axes in the transverse direction, there is no necessity to orient the vial in the transverse direction. On the other hand, since the polygonal vials have a limited number of symmetry axes in the transverse direction, the transverse orientation of the vial must be fixed to reproducibly attach the label at a specific place of the lateral surface of the vial. Otherwise, the label may be attached sometimes on the edge portion of the polygonal-shaped vial and other times over the corner portion of the vial.

The purpose of the present invention is to provide mechanisms that orient the vials in their transverse direction. This enables the medicine dispensing apparatus to reproducibly label the vial having a polygonal cross-sectional shape at a target place.

In accordance with one aspect of the present invention, the medicine dispensing apparatus contains a stocker, a first vial transporting unit, a vial orienting unit, a labeling unit, a second vial transporting unit, a medicine filling unit, and a vial discharging window. The stocker stocks the vial. The first vial transporting unit transports the vial from the stocker to the labeling unit. The vial orienting unit adjusts an orientation of the vial in vial's transverse direction so that one corner of the vial faces a predetermined direction. The labeling unit labels the vial. The second vial transporting unit transports the vial from the labeling unit to the medicine filling unit. The medicine filling unit fills the vial with the medicines. The second vial transporting unit also transports the vial from the medicine filling unit to the vial discharging window. And, the vial is discharged out of the medicine dispensing apparatus through the vial discharging window.

In this aspect of the invention, the vial orienting unit is provided upstream of the labeling unit. The vial orienting unit may contain a conveyer and a wall. The conveyer conveys the vial in a downstream direction, or a conveying direction, maintaining the vial standing. The wall is placed to be oblique to the conveying direction of the conveyer. And, at least a part of the wall is located over the conveyer. The conveyer and the wall make the vial move along the wall, maintaining the orientation of the vial constant while the vial is moving along the wall. When the vial reaches a predetermined position, at least a front portion of the wall moves and opens a path for the vial to move on the conveyer in the conveying direction.

In another aspect of the invention, the vial orienting unit is provided upstream of the labeling unit. The vial orienting unit may contain a conveyer, a first wall and a second wall. The conveyer conveys the vial in its conveying direction. The first wall is placed oblique to the conveying direction of the conveyer. And, at least a part of the first wall is located over the conveyer and configured to contact with a first edge portion of the lateral surface of the vial. The second wall is placed oblique to the conveying direction of the conveyer. And, at least a part of the second wall is located over the conveyer and configured to contact with a second edge portion of the lateral surface of the vial. The first wall and the second wall block the vial from moving in the conveying direction across the first wall and the second wall at a default state. After the first edge portion of the vial touches the first wall and the second edge portion of the vial touches the second wall, the first wall and the second wall open a path for the vial to move in the conveying direction.

In yet another aspect of the invention, the vial orienting unit is provided near the labeling unit. The vial orienting unit may contain a gripping device. The gripping device contains at least one arm which has a surface having a shape corresponding to a shape of a portion of a lateral side of the vial.

The gripping device may contain a first arm and a second arm. The first arm has a contacting surface, whose shape corresponds to the shape of the edge portion of the lateral surface of the vial. The second arm has a contacting surface, whose shape corresponds to the shape of the corner portion of the lateral surface of the vial. Both the contacting surfaces of the first arm and the second arm may be curved.

Alternatively, the gripping device may contain three arms. The arms are configured to press the edge portion of the lateral surfaces of the vial or the corner portion of the lateral surfaces of the vial. It is preferable that the arms are placed approximately in circle.

Alternatively, the vial orienting unit may contain a wall and an arm. The arm is facing the wall and configured to move in a direction perpendicular to the wall. The arm has a surface having a shape that fits with the shape of the edge or corner portion of the lateral side of the vial.

In yet another aspect of the invention, the labeling unit is configured to paste one label on two edge portions of the vial covering the corner formed between the two edge portions. In such a configuration, the labeling unit may contain a label feeding device and a pair of rollers. The label feeding device can provide the label to a place that is in front of the corner portion of the vial. Each of the rollers can trace the edge portion of the lateral surface of the vial from one corner portion to another corner portion. Each roller may be coupled to an arm. The pair of arms may be pivoted by a shaft so that they can open and close in coordination with the movement of the rollers.

Alternatively, the labeling unit may contain a label feeding device and a label transfer device. The label feeding device can feed plural labels. The label transfer device can transfer one label from the label feeding device to one edge portion of the lateral side of the vial and paste the label on the edge portion of the vial. Then, the label transfer device can also transfer another label from the label feeding device to another edge portion of the vial and paste said another label on another edge portion of the vial. The positions where the label transfer device is located is different when the label transfer device is transferring the one label to the first edge portion and when the label transfer device is transferring said another label to the second edge portion.

The medicine dispensing apparatus may contain a vial holding unit that holds the vial so that the position and orientation of the vial does not change while the labeling unit is labeling the vial. The labeling unit may engage with the neck portion of the vial to fix the vial.

In another aspect of the invention, the vial orienting unit is configured to orient the vial that is lying down. In such a configuration, the vial orienting unit may contain a conveyer having a belt, and a member that lays down the vial. The belt has a curved transverse cross-sectional shape so that the center of the belt is lower than the transverse end of the belt. The member is provided above the conveyer and lays down the vial so that one edge portion of the vial touches the belt of the conveyer.

The labeling unit may include plural feeders and plural pressing surfaces.

The feeder feeds the label in a direction approximately parallel to the edge portion of the vial. The feeder also places the label near the edge portion. The pressing surface is placed approximately parallel to the edge portion of the vial and presses the label onto the edge portion of the vial.

In yet another aspect of the present invention, the vial orienting unit may contain a first sloping surface and a second sloping surface. The first sloping surface protrudes more in a horizontal direction as it goes downward. And, the second sloping surface protrudes more in the horizontal direction as it goes downward. The first sloping surface and the second sloping surface are facing each other. The vial is placed between the first sloping surface and the second sloping surface. And, the first sloping surface and the second sloping surface move toward the vial. Lower portions of the first sloping surface and the second sloping surface go under the vial and lift the vial. The first sloping surface and the second sloping surface stop moving after a first edge portion of the vial contacts with the first sloping surface and a second edge portion of the vial contacts with the second sloping surface.

The vial orienting unit may further contain a roller. The roller rotates the vial around a rotational axis that extends in a longitudinal direction of the vial. Moreover, the roller moves along a third edge portion of the vial and presses the label placed on the third edge portion of the vial.

In yet another aspect of the invention, the vial orienting unit may contain a first conveyer and a second conveyer. The first conveyer has a first belt and a second belt. The first belt and the second belt extend in a same direction and symmetrically placed across a symmetrical plane, which extends in a vertical direction and a longitudinal direction of the first conveyer. The downstream end of the first conveyer is preferably extending further in the downstream direction compared to the downstream end of the second conveyer. The second conveyer is placed below the first conveyer. The second conveyer has a third belt and a fourth belt. The third belt is preferably placed in parallel to the first belt. The fourth belt is preferably placed in parallel to the second belt. The vial changes its orientation in its transverse direction while the vial is moving from the first conveyer to the second conveyer. The edge portion of the lateral surface of the vial, which has been facing upward in the first conveyer, faces the third belt or the fourth belt after entering the second conveyer.

In another aspect of the invention, the vial transporting unit may contain a gripping device, which is equipped with plural arms. The gripping device can grip the vial and carry the vial from proximity of the stocker to proximity of the labeling unit. Furthermore, the gripping device can rotate the vial around the rotational axis extending in the longitudinal direction of the vial and passing approximately the center of the vial.

In yet another aspect of the present invention, the vial transporting unit may contain a vial rotating unit. The vial rotating unit may contain a rotational floor and a mouth engaging piece. The rotational floor can rotate around a rotational axis extending in a vertical direction and passing approximately the center of the rotational floor. The vial is configured to be put on the rotational floor. The mouth engaging piece can engage with the opening of the vial. While engaging with the vial, the mouth engaging piece can rotate around the rotational axis extending in the vertical direction and passing approximately the center of the mouth engaging piece. When the mouth engaging piece engages with the vial, the rotational axis of the mouth engaging piece corresponds to the rotational axis of the rotational floor.

In yet another aspect of the present invention, the medicine dispensing apparatus may contain a vial orientation detection unit that detects the transverse orientation of the vial. The vial orientation detection unit may contain a light source and a light detector. The light source emits light. The light detector detects the light emitted by the light source. An optical path is formed between the light source and the light detector, and the emitted light passes the optical path. When the vial rotates, the optical path may be perpendicular or parallel to the rotational axis of the vial. The length of the normal line connecting the optical path to the rotational axis of the vial is shorter than the length of line connecting the corner of the vial to the center of gravity of the vial. The length of the normal line connecting the optical path to the rotational axis of the vial is longer than the length of line connecting the middle point of the edge portion of the lateral surface of the vial to the center of gravity of the vial.

Alternatively, the vial orientation detection unit may contain a switch provided near the vial and in front of the lateral surface of the vial. While the vial is rotating around the rotational axis extending in the longitudinal direction of the vial, the edge portion of the lateral surface of the vial does not press the switch but the corner portion of the vial does press the switch.

Alternatively, the vial orientation detection unit may contain a distance sensor facing to the lateral surface of the vial. The distance sensor can detect the distance between the distance sensor and the lateral surface of the vial.

Alternatively, the vial orientation detection unit may contain a camera and a computer, which contains a CPU. The camera captures an appearance of the vial. The computer receives the datum captured by the camera. The computer compares the appearance datum generated by the camera with a reference appearance datum stored in the computer to detect the transverse orientation of the vial.

In yet another aspect of the present invention, the medicine dispensing apparatus may contain a vial orientation determining unit, which physically determines the orientation of the vial in the transverse direction of the vial. The vial orientation determining unit may contain a stopper. The front end of the stopper is positioned so that there is a gap between the front end of the stopper and the lateral surface of the vial when the vial is orienting so that the middle of the edge portion of the vial is facing to the front end of the stopper. The front end of the stopper is further configured so that a predetermined place of the lateral surface of the vial hits the stopper while the vial is rotating.

Alternatively, the vial orientation determining unit may contain a hole that has a shape similar to a shape of the bottom surface of the vial. The vial falls into the hole when the position of the corner portion of the vial matches to the position of the corner portion of the hole while the vial is rotated over the hole.

DETAILED DESCRIPTION OF THE INVENTION

Embodiments of the present invention will be described hereinafter with reference to the accompanying drawings, in which preferred exemplary embodiments of the invention are shown. The ensuing description is not intended to limit the scope, applicability or configuration of the disclosure. Rather, the ensuing description of the preferred exemplary embodiments will provide those skilled in the art with an enabling description for implementing preferred exemplary embodiments of the disclosure. It should be noted that this invention may be embodied in different forms without departing from the spirit and scope of the invention as set forth in the appended claims.

In the following, the embodiments of the present invention are explained in detail with sections individually describing:

- § 1. First Embodiment of the Medicine Dispensing Apparatus
  - § 1.1 Overview of the Medicine Dispensing Apparatus
  - § 1.2 Vials Used for the Medicine Dispensing Apparatus
  - § 1.3 First Vial Orienting Unit
    - § 1.3.1 First Embodiment of the First Vial Orienting Unit
    - § 1.3.2 Second Embodiment of the First Vial Orienting Unit
  - § 1.4 Second Vial Orienting Unit
    - § 1.4.1 First Embodiment of the Second Vial Orienting Unit
    - § 1.4.2 Second Embodiment of the Second Vial Orienting Unit
    - § 1.4.3 Third Embodiment of the Second Vial Orienting Unit
    - § 1.4.4 Fourth Embodiment of the Second Vial Orienting Unit
  - § 1.5 Labeling Unit
    - § 1.5.1 First Embodiment of the Labeling Unit
    - § 1.5.2 Second Embodiment of the Labeling Unit
- § 2. Second Embodiment of the Medicine Dispensing Apparatus
  - § 2.1 Overview of the Medicine Dispensing Apparatus
  - § 2.2 Third Vial Orienting Unit
    - § 2.2.1 First Embodiment of the Third Vial Orienting Unit
    - § 2.2.2 Third Embodiment of the Labeling Unit
  - § 2.3 Second Embodiment of the Third Vial Orienting Unit and Fourth Embodiment of the Labeling Unit § 2.4 Third Embodiment of the Third Vial Orienting Unit and Fifth Embodiment of the Labeling Unit
§ 3. Third Embodiment of the Medicine Dispensing Apparatus
§ 3.1 Overview of the Medicine Dispensing Apparatus
§ 3.2 First Vial Transporting Unit and Vial Rotating Unit
§ 3.2.1 First Embodiments of the First Vial Transporting Unit and Vial Rotating Unit
§ 3.2.2 Second Embodiment of the First Vial Transporting Unit
§ 3.2.3 Second Embodiment of the Vial Rotating Unit
§ 3.3 Vial Orientation Detection Unit
§ 3.3.1 First Embodiment of the Vial Orientation Detection Unit
§ 3.3.2 Second Embodiment of the Vial Orientation Detection Unit
§ 3.3.3 Third Embodiment of the Vial Orientation Detection Unit
§ 3.3.4 Fourth Embodiment of the Vial Orientation Detection Unit
§ 3.4 Vial Orientation Determining Unit
§ 3.4.1 First Embodiment of the Vial Orientation Determining Unit
§ 3.4.2 Second Embodiment of the Vial Orientation Determining Unit

§ 1. FIRST EMBODIMENT OF THE MEDICINE DISPENSING APPARATUS

§ 1.1 Overview of the Medicine Dispensing Apparatus

Figure 1:
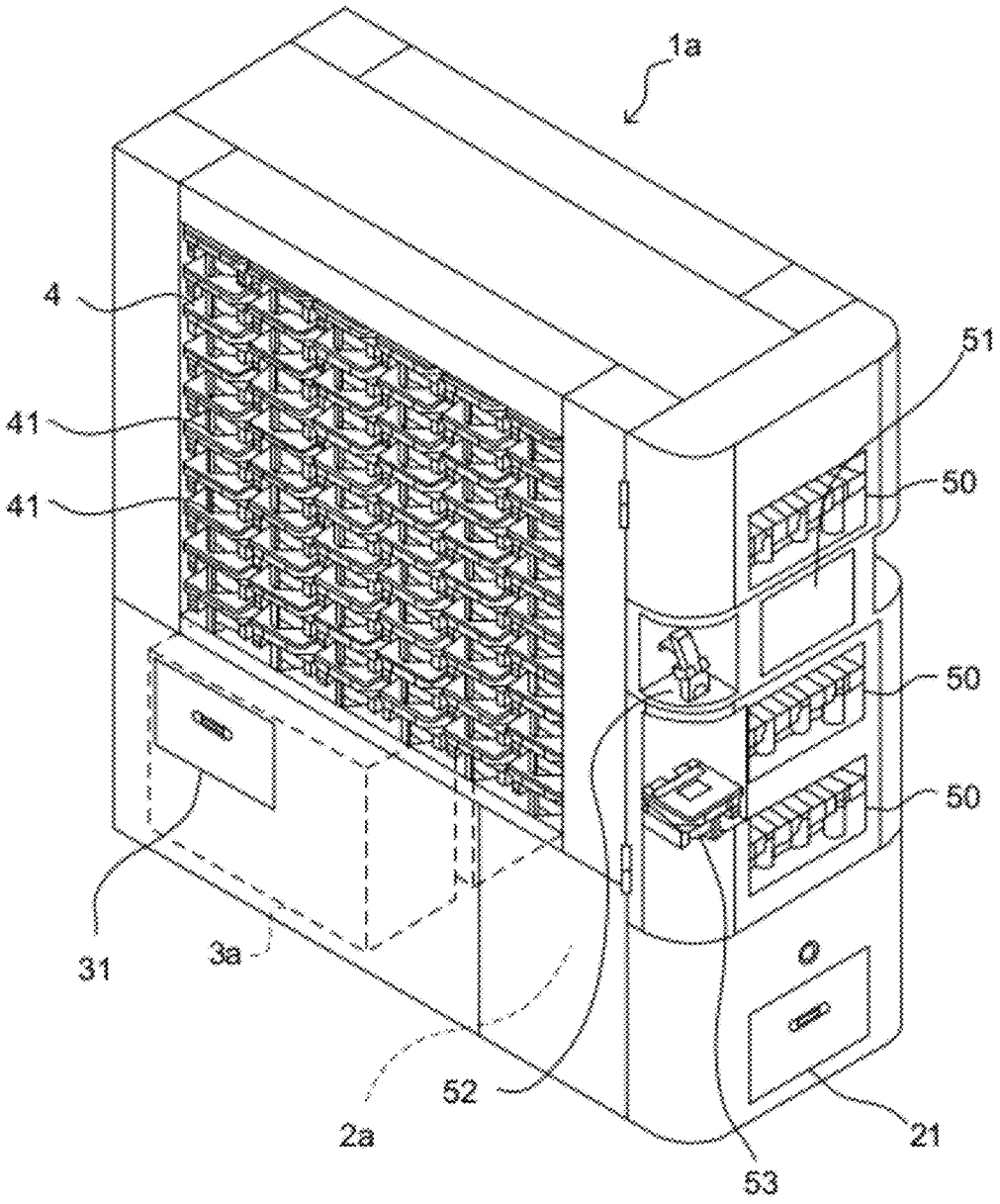
FIG. 1 is a perspective view of a first embodiment of a medicine dispensing apparatus.
Figure 2:
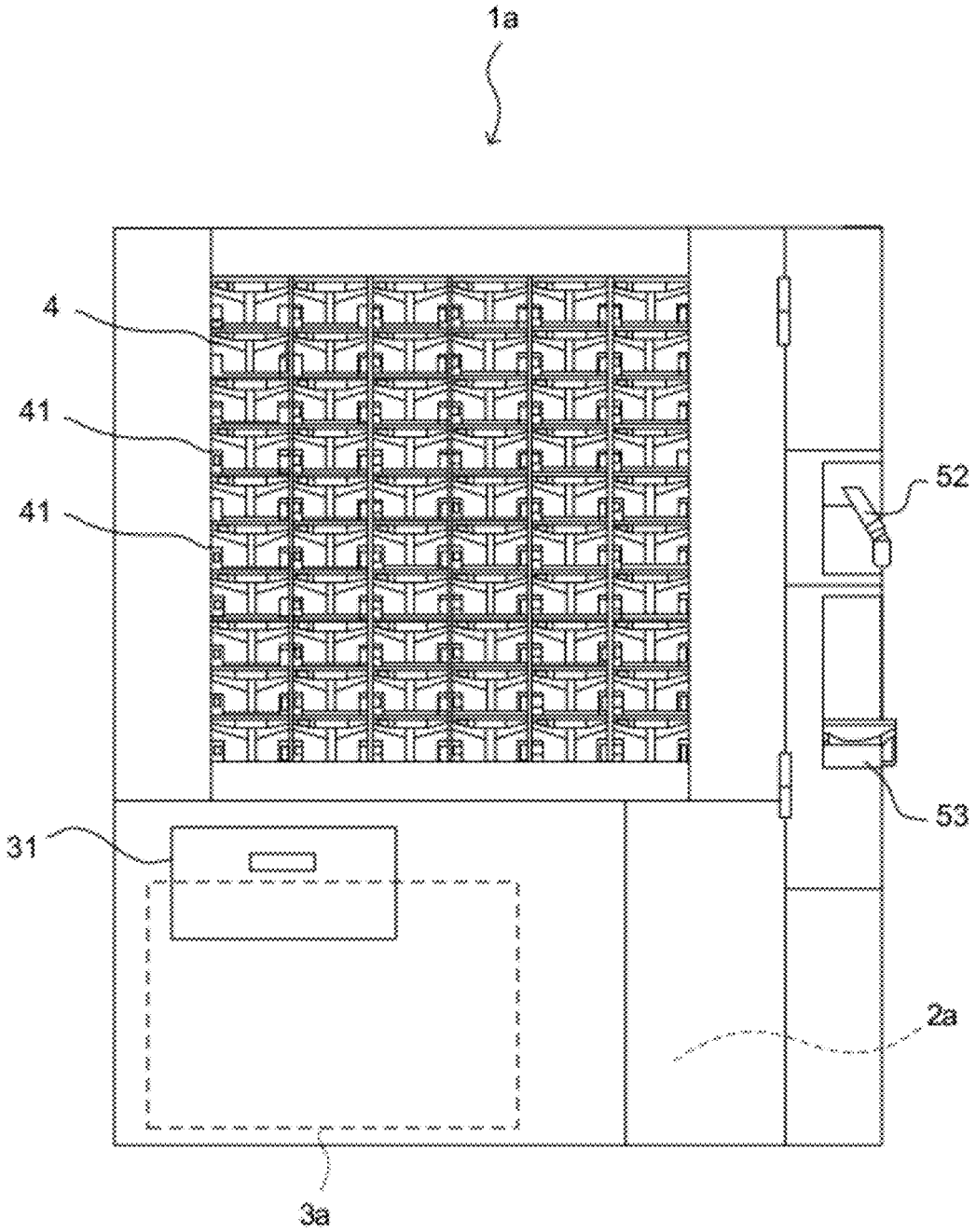
FIG. 2 is a side view of the medicine dispensing apparatus shown in FIG. 1.

FIGS. 1 & 2 show, respectively, a perspective view and a side view of the medicine dispensing apparatus in accordance with the first embodiment of the present invention. The medicine dispensing apparatus 1*a* stores various kinds of medicines and vials internally. Once the medicine dispensing apparatus 1*a* receives a prescription datum from the user, the medicine dispensing apparatus 1*a* fills a vial with the medicines specified by the prescription. Then, the medicine dispensing apparatus 1*a* discharges the vial out of the medicine dispensing apparatus 1*a* so that the pharmacist can pick it up.

As shown in FIGS. 1 & 2, the medicine dispensing apparatus 1*a* contains a vial stocker 3*a*, a labeling unit 2*a*, a medicine filling unit 4, vial discharging windows 50, a barcode reader 52, an operation panel 51, and a shelf 53. The vial stocker 3*a* stores empty vials. The user can supply vials through a side drawer 31. The labeling unit 2*a* prints a label and pastes the label on the vial. The user can pull the labeling unit 2*a* out of the medicine dispensing apparatus 1*a* through a front drawer 21. The medicine filling unit 4 contains plural canisters 41. Each canister 41 stores a specific kind of medicines and supplies the medicines to the vial.

The vial stocker 3*a* is provided inside of the medicine dispensing apparatus 1*a* and is located in the lower and rear portion of said medicine dispensing apparatus 1*a*. The labeling unit 2*a* is also provided inside of the medicine dispensing apparatus 1*a* and is located in the lower and front portion of the medicine dispensing apparatus 1*a*. The medicine filling unit 4 is provided on the lateral sides of the medicine dispensing apparatus 1*a* and is located in the upper portion of the medicine dispensing apparatus 1*a*. The vial discharging windows 50, the barcode reader 52, the operation panel 51 and the shelf 53 are provided on the front side, in the upper portion of the medicine dispensing apparatus 1*a*.

Once the user inputs a prescription datum and instructs the medicine dispensing apparatus 1*a* to dispense the prescribed medicines through the barcode reader 52 and the operation panel 51, the vial in the stocker 3*a* is sent to the labeling unit 2*a*. The labeling unit 2*a* prints a label and paste the printed label on a side surface of the vial. Then, the labeled vial is transported to the medicine filling unit 4, exactly speaking to one of the canisters 41 that contains the medicines corresponding to the prescription. There, the canister 41 supplies a prescribed number of medicines into the vial. Thereby, the vial is filled with the prescribed medicines. In the next step, the vial is transported to the vial discharging window 50 and discharged out of the medicine dispensing apparatus 1*a* through the vial discharging window 50. After discharging the vial, the user can pick up the vial filled with the prescribed medicines. The medicine dispensing apparatus 1*a* also contains a shelf 53, where the user may put the canister 41 to be refilled with a new stock of medicines.

Figure 3:
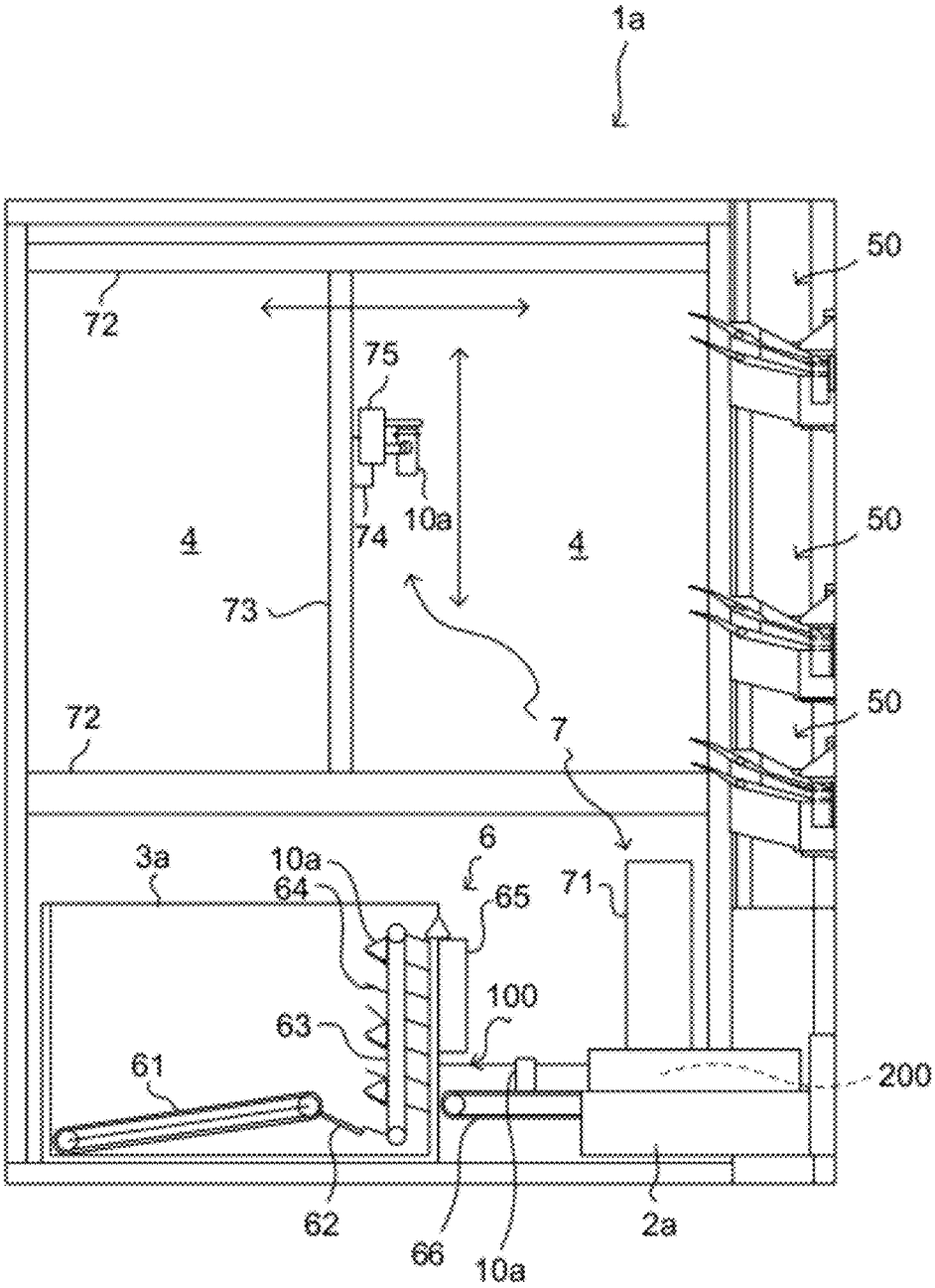
FIG. 3 is an internal side view of the medicine dispensing apparatus shown in FIG. 1.

FIG. 3 shows the internal architecture of the medicine dispensing apparatus 1*a*. As shown in this figure, the medicine dispensing apparatus 1*a* further contains the stocker 3*a*, a first vial transporting unit 6, a first vial orienting unit 100, a second vial orienting unit 200, the labeling unit 2*a*, a second vial transporting unit 7, and the vial discharging windows 50.

The first vial transporting unit 6 transports the vial 10*a* from the stocker 3*a* to the labeling unit 2*a*. The first vial transporting unit 6 contains a first conveyer 61, a guide 62, a second conveyer 63, a plurality of paddles 64, a vial erecting unit 65, and a third conveyer 66.

In this embodiment, the first vial orienting unit 100 approximately or coarsely changes the orientation of the vial 10*a*. The second vial orienting unit 200 precisely or finely determines the orientation of the vial 10*a*.

The second vial transporting unit 7 transports the vial 10*a* from the labeling unit 2*a* to the medicine filling unit 4 and further to the vial discharging window 50. The second vial transporting unit 7 contains a vial lifter 71, a pair of horizontal rails 72, a vertical rail 73, a vertically moving unit 74, and a gripping device 75.

The first conveyer 61 is provided in the bottom of the stocker 3*a* so that it inclines upward as it goes to the front side. By the front end of the first conveyer 61, the guide 62 is provided. Further, by the front end of the guide 62, the second conveyer 63 is provided. The second conveyer 63 is provided on the internal wall of the stocker 3*a*, and it extends in a vertical direction. The plurality of paddles 64 are provided on the second conveyer 63. The vial erecting unit 65 is provided by the outer front wall of the stocker 3*a*, and it is also located near a downstream end of the second conveyer 63 in front of the second conveyer 63. An upstream end of the third conveyer 66 is located immediately below the vial erecting unit 65. The third conveyer 66 horizontally extends in frontward-backward directions. A downstream end of the third conveyer 66 is located by the labeling unit 2*a*.

The first vial orienting unit 100 is provided along the third conveyer 66. In other words, the first vial orienting unit 100 is provided in an upstream of the labeling unit 2*a* in terms of the vial movement. Furthermore, the second vial orienting unit 200 is provided by the labeling unit 2*a*.

The vial lifter 71 is also provided near the labeling unit 2*a*. One of the horizontal rails 72 is provided near the vial lifter 71. The other horizontal rail 72 is provided near the ceiling of the medicine dispensing apparatus 1*a*. The horizontal rails 72 extend in frontward-backward directions inside the medicine dispensing apparatus 1*a*. A bottom end of the vertical rail 73 is coupled to the lower one of the horizontal rails 72. And, a top end of the vertical rail 73 is coupled to the upper one of the horizontal rails 72. The vertical rail 73 is movable in the frontward-backward directions along the horizontal rails 72. The vertically moving unit 74 is provided on the vertical rail 73. The vertically moving unit 74 is movable vertically along the vertical rail 73. The gripping device 75 is provided on the vertically moving unit 74. The gripping device 75 has arms, which can grip the vial 10*a*.

When the medicine dispensing apparatus 1*a* dispenses the medicines, the empty vial 10*a* in the stocker 3*a* is first conveyed in the frontward direction by the first conveyer 61. Then, the vial 10*a* drops off from the first conveyer 61 and slips down along the guide 62. Then, the vial 10*a* reaches one of the plurality of paddles 64. The plurality of paddles 64 are moving upward by the movement of the second conveyer 63. Therefore, the vial 10*a* is carried upward with its posture lying using the one paddle 64. Then, the vial 10*a* eventually reaches the top end of the second conveyer 63. There, the vial 10*a* goes over the front wall of the stocker 3*a* and enters the vial erecting unit 65. By the vial erecting unit 65, the vial 10*a* is moved downward and reaches the third conveyer 66. During this process, the vial 10*a* is erected by the vial erecting unit 65. Thus, when the vial 10*a* reaches the third conveyer 66, the vial 10*a* stands on the third conveyer 66. In other words, the vial 10*a* sits on the third conveyer 66 with its opening facing upward. Then, the erected vial 10*a* is conveyed to the labeling unit 2*a* by the third conveyer 66. During this transportation, the transverse orientation of the vial 10*a* is roughly adjusted by the first vial orienting unit 100. After reaching the labeling unit 2*a*, the transverse orientation of the vial 10*a* is accurately adjusted by the second vial orienting unit 200. Then, the lateral surface of the vial 10*a* is labeled by the labeling unit 2*a*.

After performing the labeling process, the vial 10*a* is lifted upward by the vial lifter 71. At the top portion of the vial lifter 71, the vial 10*a* is grabbed by the gripping device 75. By the frontward-backward movement of the vertical rail 73 and the upward-downward movement of the vertically moving unit 74, the vial 10*a* is positioned right by one of the canisters 41, which contains the prescribed medicines. There, the prescribed number of medicines is supplied to the vial 10*a*. After the vial is filled with the medicines, the vial 10*a* is transported to one of the vial discharging windows 50 by the movements of the vertical rail 73 and the vertically moving unit 74. There, the gripping device 75 releases the vial 10*a*. Thereby, the vial 10*a* goes out of the vial discharging window 50. Now, the vial 10*a* is ready to be picked up by the pharmacist.

The details of the stocker 3*a*, the first vial transporting unit 6, the second vial transporting unit 7, and the vial discharging windows 50 are described in the United States patent application publications US 2012/0042609, US 2011/0178634, US 2012/0031043 and US 2010/0023004 and international application PCT/JP2012/000224. The contents of these disclosures are herein incorporated by reference in their entirety.

§ 1.2 Vials Used for the Medicine Dispensing Apparatus

Figure 4:
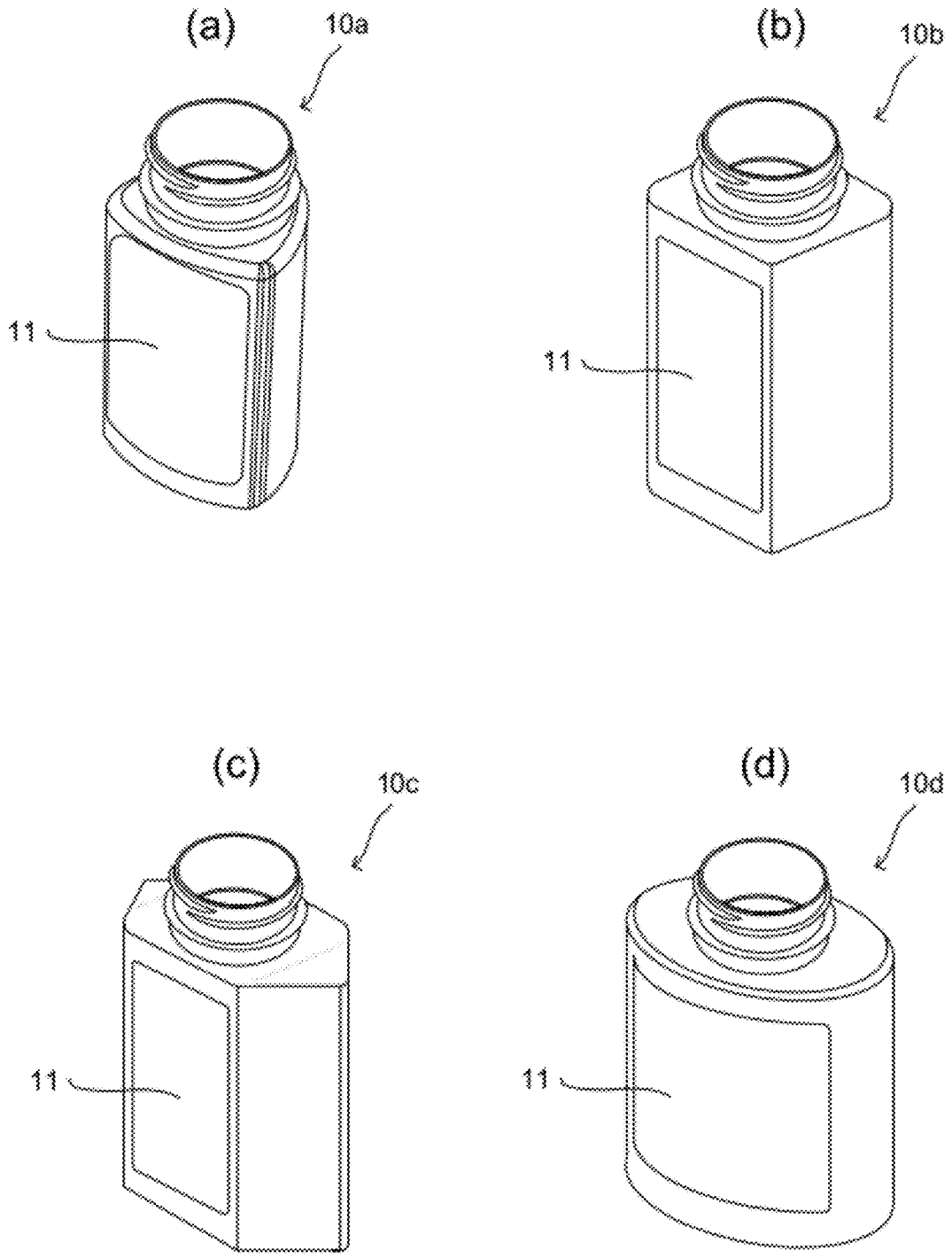
FIG. 4 is perspective views of the examples of the vials used for the medicine dispensing apparatus.

In the first embodiment, the medicine dispensing apparatus 1*a* is designed to employ the vials that have polygonal or oval transverse cross-sectional shapes as shown in FIG. 4. For the convenience of the explanation, the word 'polygonal' in this specification includes oval.

The vial 10*a* shown in FIG. 4 (*a*) has an approximately triangular transverse cross-sectional shape. Exactly speaking, the vial 10*a* has three curved edges and three rounded corners in the cross-sectional view. The three curved edges have same shape, length and curvature radius. Likewise, the three rounded corners have same shape, angle (approximately 60°) and curvature radius.

Three labels 11 can be pasted on the lateral sides of the vial 10*a*. For example, the label 11 indicating prescription information such as patient's name and name of the tablet can be pasted on one side of the vial 10*a*. The label 11 indicating information useful for the pharmacists such as prescription number and barcode can be pasted on the other side of the vial 10*a*. Lastly, the label 11 showing an advertisement of the drug store can be pasted on the last side of the vial 10*a*. Accordingly, the label 11 on each side can provide different kinds of information.

The vial 10*b* shown in FIG. 4 (*b*) has an approximately quadrilateral transverse cross-sectional shape. Exactly speaking, the vial 10*b* has four straight edges and four rounded corners in the cross-sectional view. The four edges have same shape and length. Likewise, the four rounded corners have same shape, angle (approximately 90°) and curvature radius. Four labels 11 can be pasted on the lateral sides of the vial 10*b*.

The vial 10*c* shown in FIG. 4 (*c*) has an approximately hexagonal transverse cross-sectional shape. Exactly speaking, the vial 10*c* has six straight edges and six rounded corners in the cross-sectional view. Two of the six edges facing to each other have same shape and length. And, the remaining four edges have same shape and length. The two edges are longer than the remaining four edges and optimal for pasting the labels 11.

The vial 10*d* shown in FIG. 4 (*d*) has an approximately oval transverse cross-sectional shape. Two labels 11 can be optimally pasted on lateral side portions where the curvature radii are larger.

Conventional vials have circular transverse cross-sectional shape. In this case, the vial does not have an orientation in a plan view. On the other hand, the vials 10 explained above may have orientations in a plan view. Therefore, the medicine dispensing apparatus 1*a* needs to first orient the vial 10 in its transverse direction to paste the labels 11 on the edge portion of the vial 10. Below, the mechanisms to orient the vial 10 are explained in detail. Although the vial 10*a*, which has triangular transverse cross-sectional shape, is used as an example in the below explanations, same principles are applied to the vials that have other polygonal cross-sectional shapes.

§ 1.3 First Vial Orienting Unit

§ 1.3.1 First Embodiment of the First Vial Orienting Unit

Figure 5:
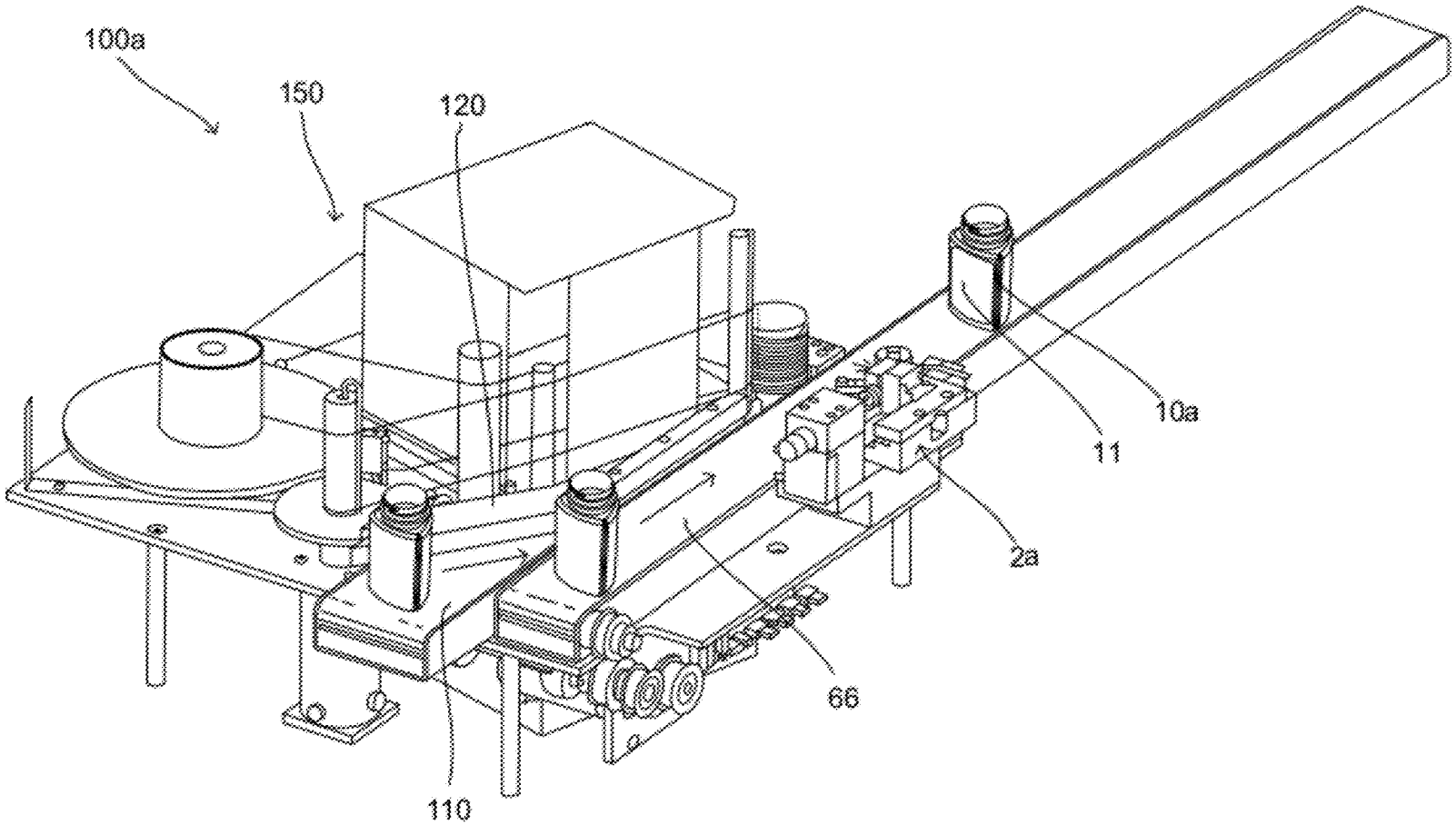
FIG. 5 is a perspective view of a first embodiment of a first vial orienting unit.

FIG. 5 shows a first embodiment of the first vial orienting unit 100*a*. Furthermore, FIG. 6 (*a*) shows a schematic diagram showing how the first vial orienting unit 100*a* orients the vial 10*a*. As shown in these figures, the first vial orienting unit 100*a* contains the third conveyer 66, a fourth conveyer 110, an oblique wall 120, a vial detector 130, and a driving unit 150.

Figure 6:
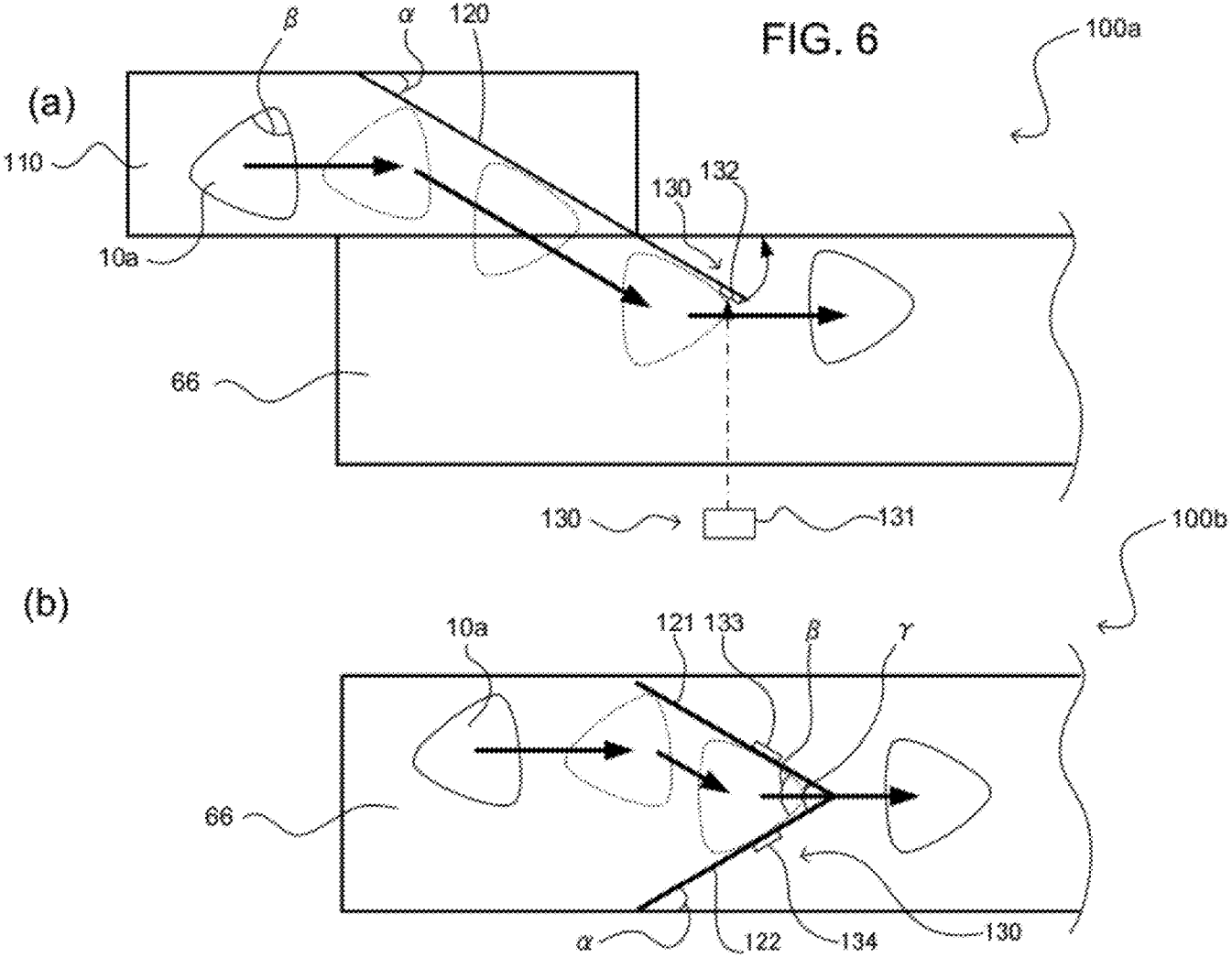
FIG. 6 is a schematic plan view to explain the action of the first vial orienting unit.

The third conveyer 66 and the fourth conveyer 110 are composed of belt conveyers that extend in the frontward-backward directions. As shown in FIGS. 5 and 6(*a*), the third conveyer 66 and the fourth conveyer 110 are placed in parallel and next to each other. Additionally, the third conveyer 66 and the fourth conveyer 110 are configured to transport the vial 10*a* placed on the conveyer in the downstream direction.

The oblique wall 120 is provided over the fourth conveyer 110 and the third conveyer 66 so that it crosses the fourth conveyer 110 and terminates in the third conveyer 66 in the plan view as shown in FIG. 6 (*a*). Accordingly, the oblique wall 120 is oblique to the moving direction of the fourth conveyer 110 and the third conveyer 66 at a certain degree α. The middle and rear portion of the oblique wall 120 blocks the above space of the fourth conveyer 110. The front portion of the oblique wall 120 is located over the third conveyer 66 at a default state. In other words, the front portion of the oblique wall 120 is located between the long edges of the third conveyer 66 at the default state as seen in a plan view. The front portion of the oblique wall 120 is movable toward the long edge of the third conveyer 66. More specifically, the front portion of the oblique wall 120 is rotatable around a rotational axis located near the long edge of the third conveyer 66 and is extending in the vertical direction so that the width of the path of the third conveyer 66 may be broaden. The width of the front portion of the oblique wall 120 is preferably longer than a width of the edge portion of the lateral surface of the vial.

On the front portion of the oblique wall 120 and near an opposing side of the third conveyer 66, the vial detector 130 is provided. The vial detector 130 is composed of a light source 131 (such as, for example, a laser light emitting diode (LED)) and a photo detector 132. The light source 131 emits a light toward the photo detector 132. Once the vial 10*a* reaches a predetermined position, the vial 10*a* blocks the light from reaching the photo detector 132. Thereby, the controller of the medicine dispensing apparatus 1*a* can detect that the vial 10*a* has reached a predetermined position on the third conveyer 66.

The driving unit 150 provides a driving force to operate the fourth conveyer 110, the third conveyer 66 and the oblique wall 120. In other words, the driving unit 150 moves the fourth conveyer 110, the third conveyer 66 and the oblique wall 120. These movements are controlled by a controller which is not shown in the drawing. Also, this controller can receive information from the vial detector 130.

Once the vial 10*a* is placed on the fourth conveyer 110 by the vial erecting unit 65 (please refer to FIG. 3), the fourth conveyer 110 conveys the vial 10*a* in the frontward direction, namely a downstream direction. Eventually, one portion of the lateral surface of the vial 10*a* hits the oblique wall 120. Once the vial 10*a* hits the oblique wall 120, the vial 10*a* rotates by the moving force of the fourth conveyer 110 so that one edge portion of the lateral surface of the vial 10*a* contacts to the oblique wall 120. Thereby, the transverse orientation of the vial 10*a* is adjusted so that one corner portion of the lateral surface of the vial 10*a* faces approximately a downstream direction of the fourth conveyer 110 and an opposing edge portion becomes approximately perpendicular to the downstream direction.

Furthermore, by the moving forces of the fourth conveyer 110 and the third conveyer 66, the vial 10*a* slides along the oblique wall 120, maintaining the one edge in contact with the oblique wall 120 and the one corner portion facing the downstream direction. As the vial 10*a* slides along the oblique wall 120, the vial 10*a* exits the fourth conveyer 110 and enters the third conveyer 66, still maintaining the one edge in contact with the oblique wall 120 and the one corner portion facing the downstream direction. Once the vial 10*a* reaches a predetermined position on the third conveyer 66, the vial detector 130 detects the presence of the vial 10*a*. Then, the controller of the medicine dispensing apparatus 1*a* moves the oblique wall 120 out of the third conveyer 66. Exactly speaking, the controller moves the oblique wall 120 out of the path of the vial 10*a* and opens the path on the third conveyer 66 for the vial 10*a*. Then, the vial 10*a* moves on the third conveyer 66 in the downstream direction toward the labeling unit 2*a*, maintaining its transverse orientation. In other words, the third conveyer 66 transports the vial 10*a* in its downstream direction, maintaining the one edge of the vial 10*a* in parallel to the oblique wall 120 before moving and the one corner portion of the vial 10*a* facing the downstream direction. After a while, the vial 10*a* reaches the labeling unit 2*a*.

To make the corner portion of the vial 10*a* face the conveying direction of the fourth conveyer 110, the angle α formed by the oblique wall 120 before moving and the conveying direction of the fourth conveyer 110 is preferably approximately one half of an interior angle β of the vial 10*a*. More specifically, the angle α is preferably at least 0.4 times and at most 0.6 times of the angle β. In the case the transverse cross-sectional shape of the vial 10*a* is approximately equilateral triangle, the angle α is preferably within a range of 24°-36°, and most preferably about 30°. In the case the transverse cross-sectional shape of the vial 10*b* is approximately square (please see FIG. 4 (*b*)), the angle α is preferably within a range of 36°-54°, and most preferably about 45°.

§ 1.3.2 Second Embodiment of the First Vial Orienting Unit

FIG. 6 (*b*) shows a second embodiment of the first vial orienting unit 100*b*. As shown in this figure, the first vial orienting unit 100*b* contains the third conveyer 66, a first oblique wall 121, a second oblique wall 122, a vial detector 130, and a driving unit 150 (not shown in FIG. 6 (*b*)).

The first oblique wall 121 and the second oblique wall 122 are provided over the conveyer 66. Seen from a plan view, both the first oblique wall 121 and the second oblique wall 122 are oblique to the moving direction of the third conveyer 66 at a certain degree α. Furthermore, the first oblique wall 121 and the second oblique wall 122 are symmetrically placed to each other across the symmetric plane, which vertically extends in the conveying direction of the third conveyer 66 and passes the middle of the first oblique wall 121 and the second oblique wall 122.

In this embodiment, the front end of the first oblique wall 121 and the front end of the second oblique wall 122 contact with each other so that the first oblique wall 121 and the second oblique wall 122 block the path of the vial 10*a* on the third conveyer 66. In other embodiment, there may be a gap between the front end of the first oblique wall 121 and the front end of the second oblique wall 122. However, the width of the gap is preferably approximately the same as or less than the maximum width of the vial 10*a*.

The first oblique wall 121 and the second oblique wall 122 are movable so that the front portions of the first oblique wall 121 and the second oblique wall 122 get out of the path of the vial 10*a* on the third conveyer 66 and unblock the path.

Near the front ends of the first oblique wall 121 and the second oblique wall 122, the vial detector 130 is provided. The vial detector 130 is composed of a first switch 133 and a second switch 134. The first switch 133 is provided on the first oblique wall 121 and the second switch 134 is provided on the second oblique wall 124. The first switch 133 and the second switch 134 are provided at a position where the first switch 133 and the second switch 134 touch the vial 10*a* when the vial 10*a* touches both the first oblique wall 121 and the second oblique wall 122 and is prevented from moving in the further downward direction by the first oblique wall 121 and the second oblique wall 122.

Once the vial 10*a* is placed on the third conveyer 66 by the vial erecting unit 65 (please refer to FIG. 3), the third conveyer 66 conveys the vial 10*a* in the downstream direction. Eventually, one portion of the vial 10*a* hits the first oblique wall 121 or the second oblique wall 122. Once the vial 10*a* hits the wall, the vial 10*a* rotates by the moving force of the third conveyer 66 and changes its transverse orientation. Furthermore, by the moving forces of the third conveyer 66, the vial 10*a* slides along the first oblique wall 121 or the second oblique wall 122. Eventually, the vial 10*a* reaches the front portions of the first oblique wall 121 and the second oblique wall 122 and is blocked by the first oblique wall 121 and the second oblique wall 122 from being moved further downstream.

Because of the moving force of the third conveyer 66, the vial 10*a* is stuck on the front portions of the first oblique wall 121 and the second oblique wall 122 with one edge portion contacting with the first oblique wall 121, the other edge portion contacting with the second oblique wall 122, and the corner portion formed between the two edges facing downstream. There, one edge portion of the lateral side of the vial 10*a* presses the first switch 133 and the other edge portion presses the second switch 134. Thereby, the first switch 133 and the second switch 134 become ON and the controller of the medicine dispensing apparatus 1*a* can detect that the vial 10*a* has reached a predetermined position and its orientation has been adjusted to be a designed orientation. Then, the controller moves the first oblique wall 121 and the second oblique wall 122 out of the path of the vial 10*b*. Then, the vial 10*a* moves along the third conveyer 66 in the downstream direction toward the labeling unit 2*a*, maintaining its transverse orientation. After a while, the vial 10*a* reaches the labeling unit 2*a*.

To make one corner portion of the vial 10*a* face the conveying direction of the third conveyer 66, the angle γ formed by the first oblique wall 121 and the second oblique wall 122 is preferably approximately the same as the interior angle β of the vial 10*a*. More specifically, the angle γ is preferably at least 0.8 times and at most 1.2 times of the angle β. In the case the transverse cross-sectional shape of the vial 10*a* is approximately equilateral triangle, the angle γ is preferably within a range of 48°-72°, and most preferably about 60°. In the case the transverse cross-sectional shape of the vial 10*b* is approximately square (please see FIG. 4 (*b*)), the angle γ is preferably within a range of 72°-108°, and most preferably about 90°.

§ 1.4 Second Vial Orienting Unit

Figure 7:
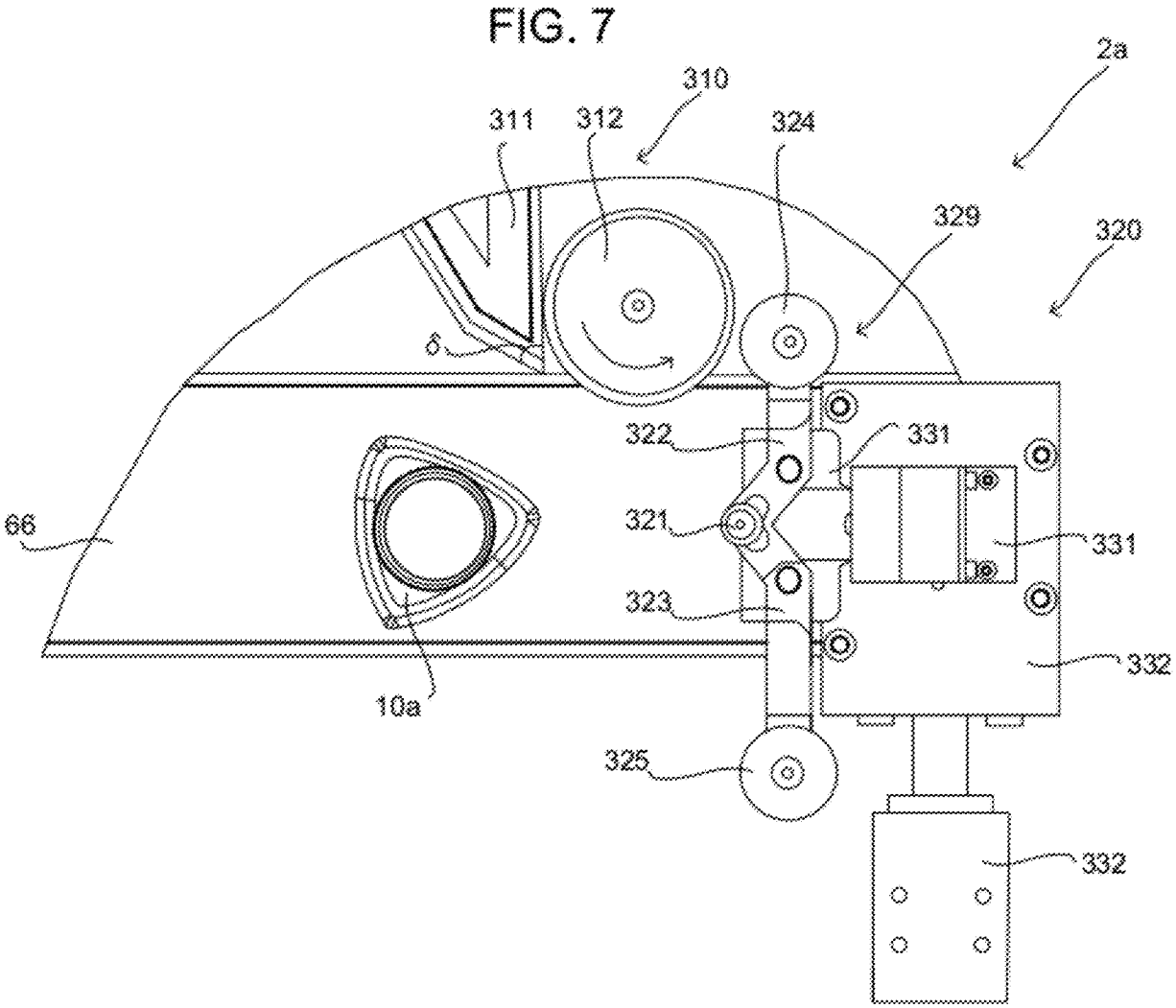
FIG. 7 is a plan view showing the labeling unit and its proximity.
Figure 8:
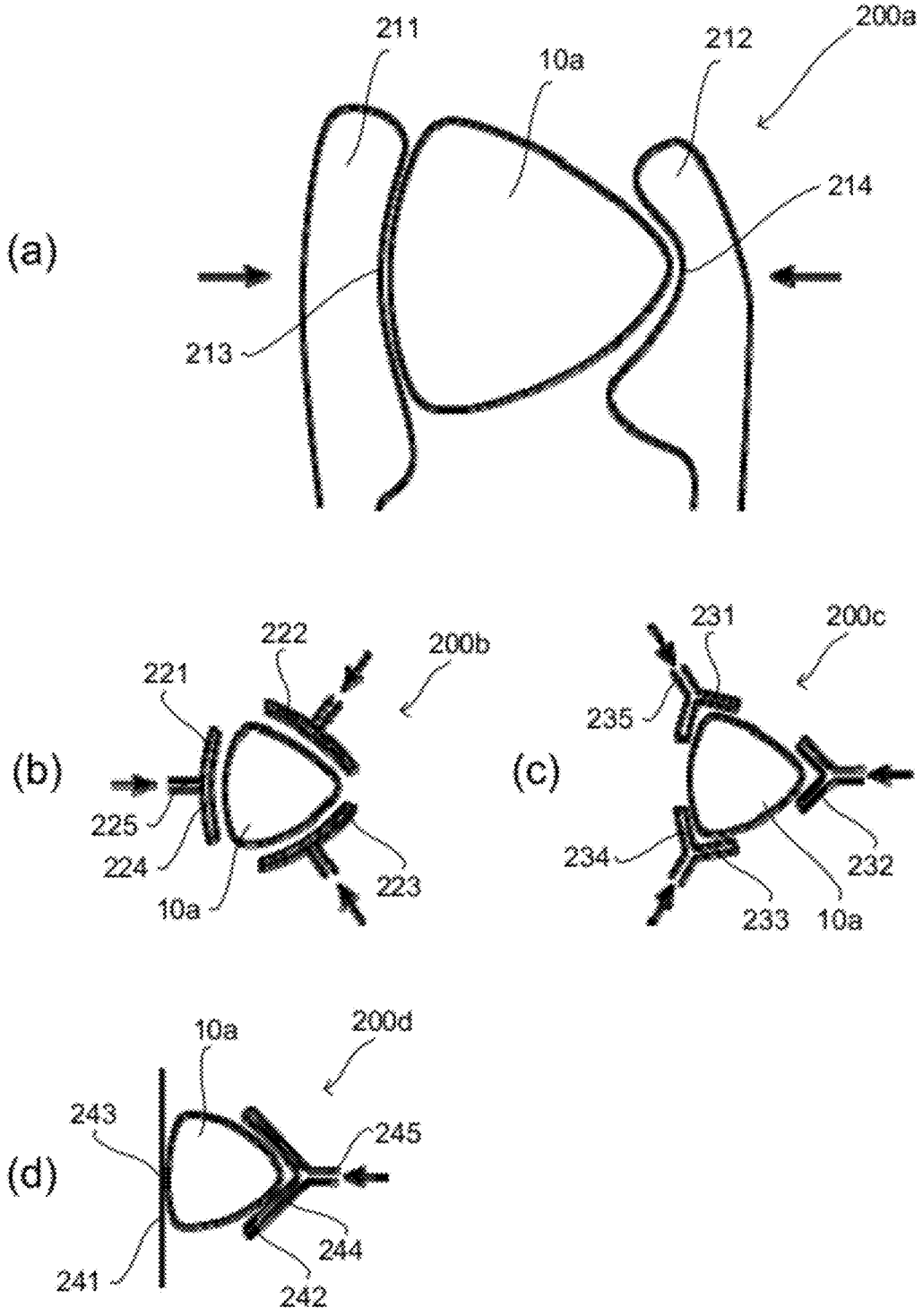
FIG. 8 is a schematic plan view to explain the action of the second vial orienting unit.

As shown in FIGS. 5 & 7, once the vial 10*a* reaches a predetermined position, near the labeling unit 2*a*, the third conveyer 66 stops moving. There, the transverse orientation of the vial 10*a* is precisely adjusted by the second vial orienting unit 200, which is placed near the labeling unit 2*a*. FIG. 8 shows the embodiments of the second vial orienting unit 200.

§ 1.4.1 First Embodiment of the Second Vial Orienting Unit

As shown in FIG. 8 (*a*), the second vial orienting unit 200*a* is composed of a gripping device containing pressing members, namely a first arm 211 and a second arm 212. The first arm 211 has a contacting surface 213 that faces inward and contacts a lateral surface of the vial 10*a*. Likewise, the second arm 212 has a contacting surface 214 that faces inward and contacts a corner portion of the vial 10*a*.

In a plan view, the contacting surface 213 of the first arm 211 is curved so that the shape of the curvature fits to the shape of the curvature of the edge portion of the lateral surface of the vial 10*a*. Furthermore, the contacting surface 214 of the second arm 212 is curved so that the shape of the curvature fits to the shape of the curvature of the corner portion of the lateral surface of the vial 10*a*. Accordingly, the curvature radius of the contacting surface 213 of the first arm 211 is larger than the curvature radius of the contacting surface 214 of the second arm 212. The curvature radius of the contacting surface 213 is preferably at least 0.8 times and at most 1.2 times of the curvature radius of the edge portion of the vial 10*a*. The curvature radius of the contacting surface 214 is preferably at least 0.8 times and at most 1.2 times of the curvature radius of the corner portion of the vial 10*a*.

The first arm 211 and the second arm 212 are configured to move so that the first arm 211 and the second arm 212 become closer to each other. Once the first arm 211 and the second arm 212 begin to press the vial 10*a*, placed between the first arm 211 and the second arm 212, the transverse orientation of the vial 10*a* is adjusted so that the edge portion and the corner portion of the vial 10*a* contact, respectively, to the contacting surface 213 and the contacting surface 214 most fittingly. Thereby, the transverse orientation of the vial 10*a* is precisely determined.

§ 1.4.2 Second Embodiment of the Second Vial Orienting Unit

As shown in FIG. 8 (*b*), the second vial orienting unit 200*b* is composed of a gripping device containing pressing members, namely a first arm 221, a second arm 222, and a third arm 223. Each of the first arm 221, the second arm 222, and the third arm 223 has an approximately T-shaped profile when seen from a plan view. Also, each of the first arm 221, the second arm 222, and the third arm 223 has a contacting surface 224 and a shaft 225. The contacting surface 224 is formed approximately perpendicular to the shaft 225.

The first arm 221, the second arm 222, and the third arm 223 are placed so that they surround the vial 10*a* as seen in a plan view. Furthermore, the angle formed by any two of the first arm 221, the second arm 222, and the third arm 223 is approximately 120°. More exactly, the angle formed by any two shafts 225 of the first arm 221, the second arm 222, and the third arm 223 is approximately 120°. Furthermore, the angle formed by any two contacting surface 224 of the first arm 221, the second arm 222, and the third arm 223 is approximately 60°.

In a plan view, the contacting surfaces 224 of the first arm 221, the second arm 222, and the third arm 223 are curved so that the shapes of the curvatures fit to the shapes of the curvatures of the edge portions of the lateral sides of the vial 10*a*. The curvature radius of the contacting surface 224 is preferably at least 0.8 times and at most 1.2 times of the curvature radius of the edge portion of the vial 10*a*. Each of the contacting surfaces 224 is configured to contact with one of the edge portions of the vial 10*a*.

Each of the first arm 221, the second arm 222, and the third arm 223 is configured to move toward the vial 10*a* in a longitudinal direction of the shaft 225. Once the first arm 221, the second arm 222, and the third arm 223 begin to press the vial 10*a*, the transverse orientation of the vial 10*a* is adjusted so that the edge portions of the vial 10*a* contact with the contacting surfaces 224 most fittingly. Thereby, the transverse orientation of the vial 10*a* is precisely determined.

§ 1.4.3 Third Embodiment of the Second Vial Orienting Unit

As shown in FIG. 8 (*c*), the second vial orienting unit 200*c* is composed of a gripping device containing pressing members, namely a first arm 231, a second arm 232, and a third arm 233. Each of the first arm 231, the second arm 232, and the third arm 233 has an approximately Y-shaped profile when seen from a plan view. Also, each of the first arm 231, the second arm 232, and the third arm 233 has a contacting surface 234 and a shaft 235.

The first arm 231, the second arm 232, and the third arm 233 are placed so that they surround the vial 10*a* as seen in a plan view. Furthermore, the angle formed by any two of the first arm 231, the second arm 232, and the third arm 233 is approximately 120°. More exactly, the angle formed by any two shafts 235 of the first arm 231, the second arm 232, and the third arm 233 is approximately 120°.

In a plan view, the contacting surfaces 224 of the first arm 221, the second arm 222, and the third arm 223 are bent so that the bent shapes fit to the shapes of the corner portions of the lateral surface of the vial 10*a*. The bent angle of the contacting surface 224 is approximately the same as the interior angle of the vial 10*a*. For example, the bent angle of the contacting surface 224 can be set as at least 0.8 times and at most 1.2 times of the interior angle of the vial 10*a*, or 48°-72° when the vial 10*a* is triangular, or 72°-108° when the vial 10*b* is rectangular. Each of the contacting surfaces 234 is configured to contact with one of the corner portions of the vial 10*a*.

Each of the first arm 231, the second arm 232, and the third arm 233 is configured to move toward the vial 10*a* in a longitudinal direction of the shaft 235. Once the first arm 231, the second arm 232, and the third arm 233 begin to press the vial 10*a*, the transverse orientation of the vial 10*a* is adjusted so that the corner portions of the vial 10*a* contact to the contacting surfaces 234 most fittingly. Thereby, the transverse orientation of the vial 10*a* is precisely determined.

§ 1.4.4 Fourth Embodiment of the Second Vial Orienting Unit

As shown in FIG. 8 (*d*), the second vial orienting unit 200*d* is composed of two pressing members, which are a wall 241 and an arm 242. The arm 242 has an approximately Y-shaped profile when seen from a plan view. Also, the arm 242 has a contacting surface 244 and a shaft 245. The wall 241 also has a contacting surface 243. The wall 241 and the arm 242 are placed so as to face to each other and the shaft 245 is approximately perpendicular to the wall 241. In this way, the vial 10*a* is configured to be located between the wall 241 and the arm 242.

In a plan view, the contacting surface 244 of the arm 242 is bent so that the bent shape fits to the shape of the corner portion of the lateral side of the vial 10*a*. The bent angle of the contacting surface 244 is approximately the same as the interior angle of the vial 10*a*. The contacting surface 244 is configured to contact the corner portion of the vial 10*a* as well as parts of the edge portions of the vial 10*a* connecting to said corner portion. The width from the bent of the arm 242 to the front end of the arm 242 is preferably more than one third of the width of the edge portion of the lateral surface of the vial 10*a*. The contacting surface 243 of the wall 241 is also configured to contact the edge portion of the vial 10*a*.

The arm 242 is configured to move toward the wall 241 in a longitudinal direction of the shaft 245. Once the arm 242 begins to press the vial 10*a*, the position of the vial 10*a* is adjusted so that the edge portion of the vial 10*a* contacts with the contacting surface 243 of the wall 241. Furthermore, by the pressing force of the arm 242, the transverse orientation of the vial 10*a* is adjusted so that the corner portion and the edge portion of the vial 10*a* contact, respectively, with the contacting surfaces 244 and 243 most fittingly. Thereby, the transverse orientation of the vial 10*a* is precisely determined.

In other embodiment, the wall 243 may have a curved surface that fits to the curvature of the edge portion of the vial 10*a*.

§ 1.5 Labeling Unit

Figure 9:
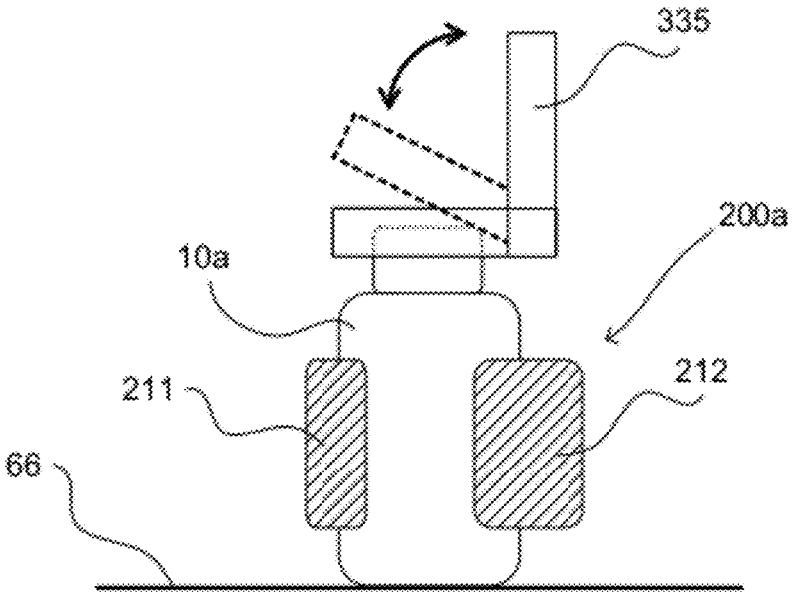
FIG. 9 is a schematic side view showing a vial holding unit.

After the orientation of the vial 10*a* is precisely determined by the second vial orienting unit 200, the vial 10*a* is labeled by the labeling unit 2*a* as shown in FIGS. 7 & 9.

§ 1.5.1 First Embodiment of the Labeling Unit

As shown in FIGS. 7 & 9, the labeling unit 2*a* contains a printer (not shown in the drawing), a label feeding device 310, a label pasting device 320, and a vial holding unit 335. First, the printer prints a label. Then, the label feeding device 310 feeds the printed label to a position located near the vial 10*a*. At last, the label pasting device 320 pastes the label on the lateral surface of the vial 10*a*. The vial holding unit 335 holds the vial 10*a* while the labeling unit 2*a* is pasting the label on the vial 10*a*.

The label feeding device 310 contains a guide flap 311 and a guide roller 312. A lateral surface of the guide flap 311 is oriented so that the lateral surface is perpendicular to the third conveyer 66. The lateral surface of the guide flap 311 provides a path along which the label slides. As seen in FIG. 7, the tip of the guide flap 311 is sharply angled. It is preferable that the angle δ, which is formed at the end of the guide flap 311 by the lateral surface and its opposing surface of the guide flap 311, is 60° or less when the vial 10*a* has the triangular cross-sectional shape. The guide roller 312 feeds the label along and out of the guide flap 311. The guide flap 311 and the guide roller 312 are configured to move horizontally between the positions off the third conveyer 66 and over the third conveyer 66.

As shown in FIG. 9, the vial holding unit 335 is provided above the vial 10*a*. The vial holding unit 335 can rotate around the rotational axis, which is parallel to a transverse direction of the vial 10*a*. Thereby, the vial holding unit 335 can have two postures, one of which is erected and the other one is laid down. When the vial holding unit 335 is laid down, the vial holding unit 335 can engage with the neck portion of the vial 10*a* and press it downwardly. Thereby, the vial 10*a* is prevented from moving or rotating.

Referring back to FIG. 7, the label pasting device 320 contains a pasting unit 329, a drive unit 331 and a moving unit 332. The pasting unit 329 contains a pivot 321, a pair of first arm 322 and second arm 323, and a pair of first roller 324 and second roller 325. The first arm 322 and the second arm 323 are symmetrically placed to each other with respect to the center of the pivot 321. Axial ends of the first arm 322 and the second arm 323 are pivoted by the pivot 321. The first roller 324 and the second roller 325 are provided at the circumferential ends of the first arm 322 and the second arm 323 respectively.

The pivot 321, the first arm 322, and the second arm 323 are coupled to the drive unit 331. The drive unit 331 provides a driving force so that the first arm 322 and the second arm 323 can rotate around the pivot 321. The first arm 322 and the second arm 323 can rotate by approximately 90° to change their orientations. In one state, the first arm 322 and the second arm 323 orient approximately perpendicular to the conveying direction of the third conveyer 66 while in an alternative state, the first arm 322 and the second arm 323 orient a direction opposite to the conveying direction of the third conveyer 66.

The drive unit 331 is coupled to the moving unit 332. The moving unit 332 moves the drive unit 331 so that the drive unit 331 and parts attached to the drive unit 331 change their positions horizontally, between the positions off the third conveyer 66 and over the third conveyer 66.

As shown in FIG. 9, after the second vial orienting unit 200*a* precisely adjusts the orientation of the vial 10*a* but while still gripping the vial 10*a* by the first arm 211 and the second arm 212, the vial holding unit 335 comes down to the neck portion of the vial 10*a* and holds the neck portion. Thereby, the posture of the vial 10*a* is fixed by the vial holding unit 335. Then, the first arm 211 and the second arm 212 goes away from the vial 10*a*.

Figure 10:
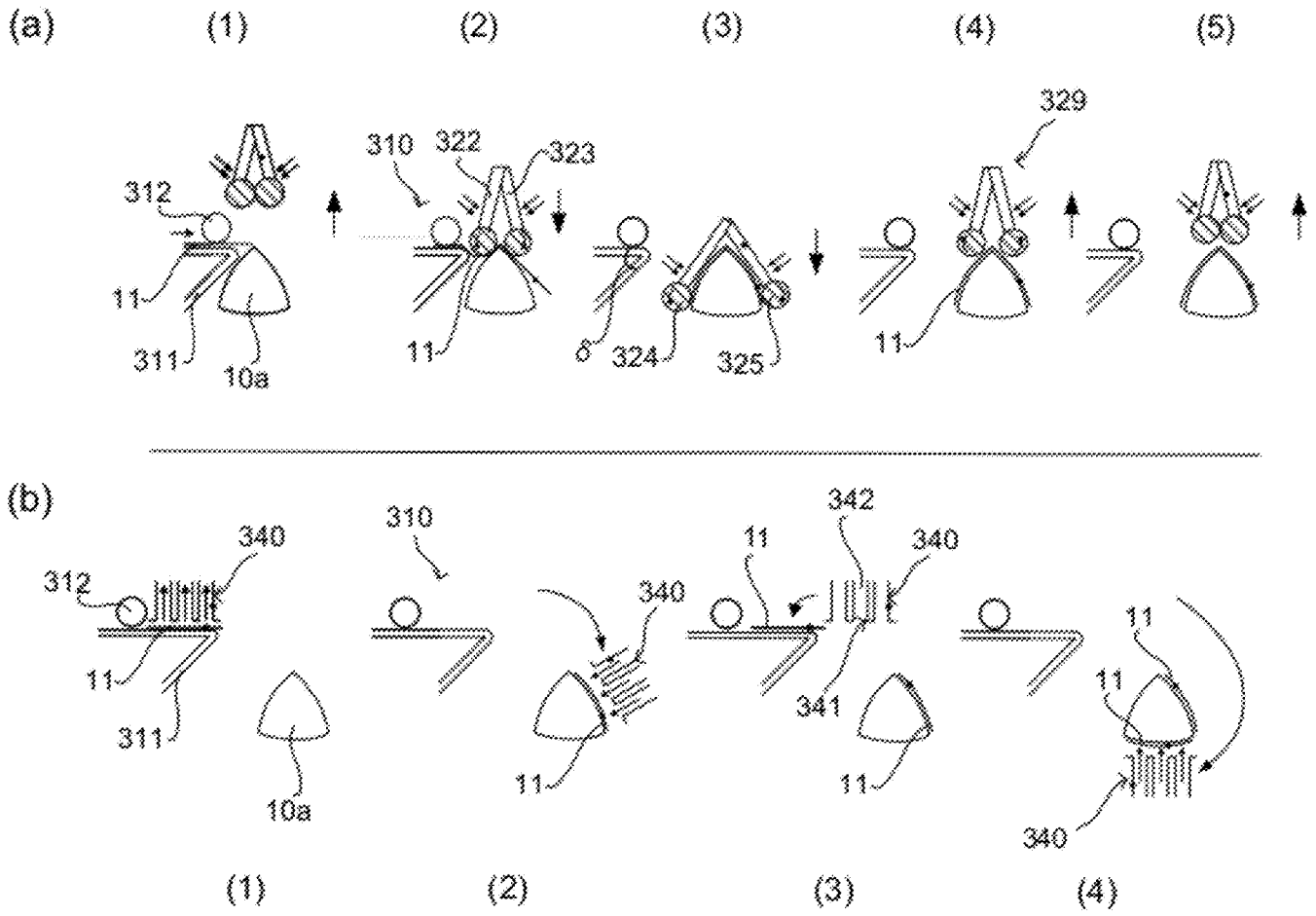
FIG. 10 is a schematic plan view to explain the action of the labeling unit.

Next, as shown in FIG. 7, the pasting unit 329 is moved near the vial 10*a* over the third conveyer 66. As shown in FIG. 10 (*a*) (1), the label feeding device 310 is also moved near the vial 10*a* so that the guide flap 311 is positioned right by the vial 10*a*. The printed label 11 is fed by the printer (not shown in the drawing) and sent to the guide flap 311. There, about half of the label 11 is fed out of the guide flap 311 by the guide roller 312. When the center of the label 11 is positioned approximately right in front of the corner portion of the vial 10*a*, as seen in a plan view, the guide roller 312 pauses feeding the label 11. Along with these movements, the first arm 322 and the second arm 323 are closed so that the first roller 324 and the second roller 325 are positioned in front of the corner portion of the vial 10*a*.

As shown in FIG. 10 (*a*) (2), the first arm 322 and the second arm 323 moves toward the corner portion of the vial 10*a* and press the corner portion of the vial 10*a* via the label 11. Thereby, the label 11 is pressed by the first roller 324 and the second roller 325. Almost at the same timing, the guide roller 312 resumes feeding the label 11 and the label feeding device 310 goes away from the vial 10*a*. Thereby, the label 11 is released from the guide flap 311 but remains on the corner portion of the vial 10*a* because the label 11 is pressed to the vial 10*a* by the first roller 324 and the second roller 325. By coordinating with the movement of the guide flap 311, the first arm 322 and the second arm 323 move further toward the vial 10*a*.

As shown in FIG. 10 (*a*) (3), the first arm 322 and the second arm 323 further moves deeper toward the vial 10*a*. More exactly speaking, they move toward the other corner portions of the vial 10*a*. By coordinating with this movement, the first arm 322 and the second arm 323 open so that the first roller 324 and the second roller 325 trace edge portions of the lateral surface of the vial 10*a*. During this movement, the first roller 324 and the second roller 325 rotate inwardly so that the first roller 324 and the second roller 325 smoothly move on the edge portions of the vial 10*a* towards the other corner portions of the vial 10*a*, while keep pressing the label 11 on the lateral surface of the vial 10*a*. Thereby, the label 11 is pasted on the lateral surface of the vial 10*a*.

As shown in FIG. 10 (*a*) (4), once the first roller 324 and the second roller 325 reach the other corner portions of the vial 10*a*, the first arm 322 and the second arm 323 are pulled back. During this movement, the first roller 324 and the second roller 325 traces the same surfaces of the vial 10*a* as those when the first roller 324 and the second roller 325 moved forward. However, at this time, the movement of the first roller 324 and the second roller 325 are in the opposite direction. Exactly speaking, the first roller 324 and the second roller 325 trace the edge portions of the lateral surface of the vial 10*a* toward the corner portion of the vial 10*a*, which is located in the most frontward direction, or the downstream direction. By coordinating with this movement, the first arm 322 and the second arm 323 close. During this movement, the first roller 324 and the second roller 325 rotate outwardly. Thereby, adherence of the label 11 to the vial 10*a* becomes stronger.

As shown in FIG. 10 (*a*) (5), the first arm 322 and the second arm 323 leave the vial 10*a* eventually and go back to their original position. By the above process, one label 11 is pasted on the two edge portions of the vial 10*a* across the corner portion of the vial 10*a*.

§ 1.5.2 Second Embodiment of the Labeling Unit

FIG. 10 (*b*) shows a second embodiment of labeling unit 2*a*. The labeling unit 2*a* shown in FIG. 10 (*b*) can paste the label on each edge portion of the vial 10*a* one by one. The labeling unit 2*a* contains a label feeding device 310 and a label transfer device 340.

The label transfer device 340 transfers the label 11 from the label feeding device 310 to the vial 10*a*. The label transfer device 340 is equipped with an attaching surface 341, a vacuum (not shown in the drawing) and nozzles 342. The nozzles 342 are coupled to the vacuum. Mouths of the nozzles 342 are located on the attaching surface 341. Furthermore, the nozzles 342 can suck and blow an air through their mouths. Thereby, the label transfer device 340 may take, hold and release the label 11 on and from the attaching surface 341. Furthermore, the label transfer device 340 can rotate and move horizontally. The label transfer device 340 can go back and forth between the label feeding device 310 and the vial 10*a*. The label feeding device 310 can also change its orientation so that the attaching surface 341 can face the edge portion of the lateral surface of the vial 10*a* and the attaching surface 341 and the edge portion become approximately parallel to each other.

After adjusting the orientation of the vial 10*a*, by the second vial orienting unit 200, and further holding firmly the vial 10*a* by the vial holding unit 335, as shown in FIG. 10 (*b*) (1), the printed label 11 is fed to the front end portion of the guide flap 311 by the guide roller 312. Then, the label transfer device 340 moves to the label feeding device 310 and thereby the attaching surface 341 comes in contact with the label 11. Next, the vacuum (not shown in the drawing) is on and the nozzles 342 suck air. Thereby, the label 11 is attached to the attaching surface 341.

Referring next to FIG. 10 (*b*) (2), the label transfer device 340 moves toward the vial 10*a* and positions itself near a first edge portion of the lateral surface of the vial 10*a*, facing the attaching surface 341 to the first edge portion. Then, the attaching surface 341 comes in contact with the first edge portion. Thereby, the label 11 is pasted on the first edge portion. In the next step, the vacuum reverses its air flow and the nozzles 342 blow air toward the surface of the attaching surface 341. Thereby, the label 11 is further pressed onto the first edge portion. As a result, the pasting may be performed more firmly. Thereafter, the label transfer device 340 leaves the first edge portion.

As shown in FIG. 10 (*b*) (3), another label 11 is fed to the front end portion of the guide flap 311. The label transfer device 340 moves back to the label feeding device 310 and picks up another label 11.

With reference to FIG. 10 (*b*) (4), the label transfer device 340 moves to the vial 10*a* again and positions itself in front of a second edge portion of the vial 10*a*, facing the attaching surface 341 to the second edge portion. Then, the label transfer device 340 pastes the label 11 on the second edge portion of the vial 10*a*. Likewise, the label transfer device 340 may paste another label on a third edge portion of the vial 10*a*.

In the above embodiment, the label transfer device 340 could go to at least three places, the label feeding device 310, the first edge portion and the second edge portion of the vial 10*a* without rotating the vial 10*a*. In other embodiment, the vial 10*a* may be rotated after one label is pasted and the label feeding device 310 may be configured to go back and forth only between two locations, the label feeding device 310 and a fixed position by the vial 10*a*.

In yet another embodiment, the attaching surface 341 may be curved so that the shape of curve or a curvature radius of the attaching surface 341 corresponds to the shape or curvature radius of the edge portion of the vial 10*a*.

§ 2. SECOND EMBODIMENT OF THE MEDICINE DISPENSING APPARATUS

§ 2.1 Overview of the Medicine Dispensing Apparatus

Figure 11:
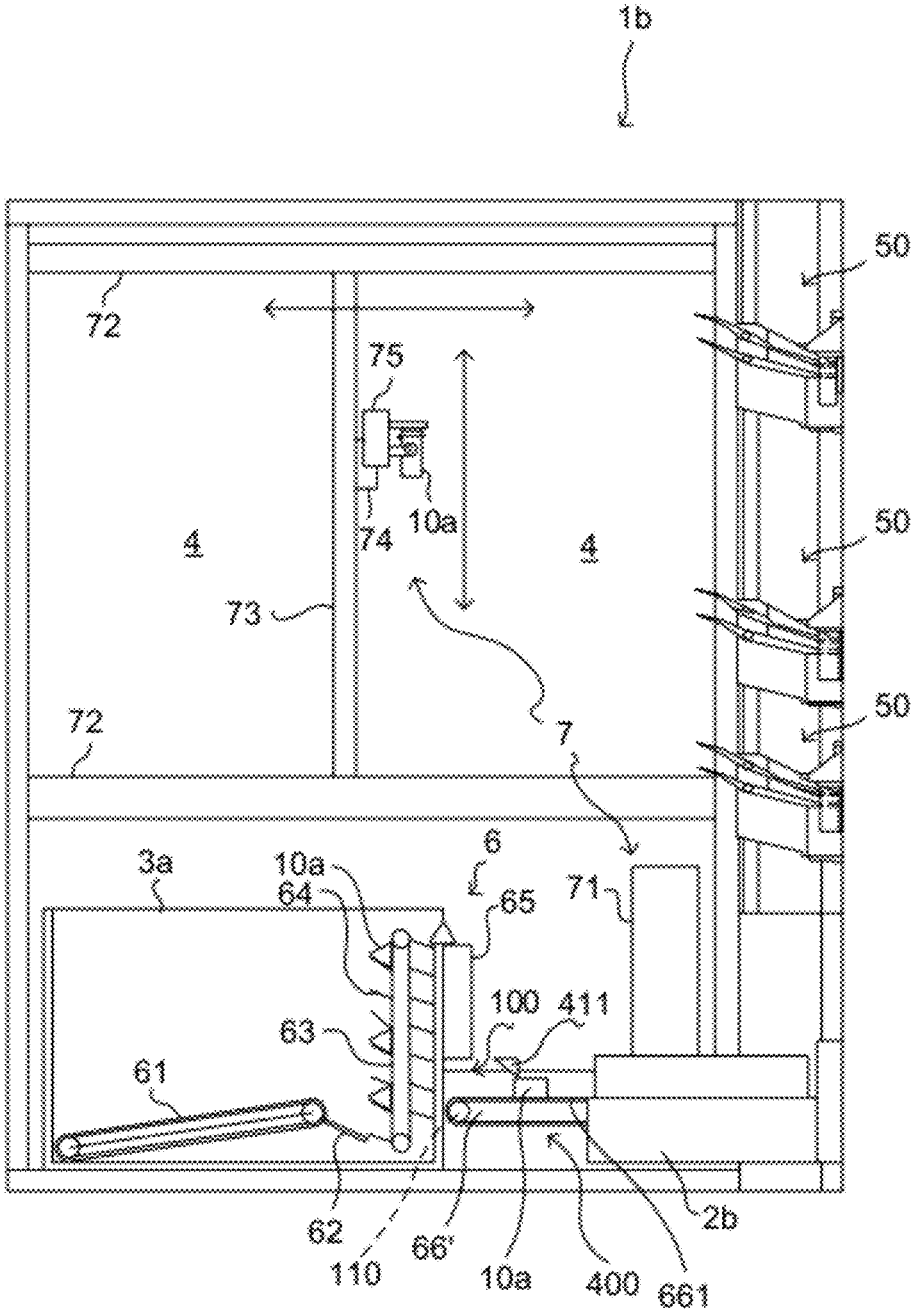
FIG. 11 is an internal side view of a second embodiment of the medicine dispensing apparatus.

FIG. 11 shows the internal architecture of the medicine dispensing apparatus 1*b*. As shown in this figure, the medicine dispensing apparatus 1*b* contains a third vial orienting unit 400 instead of the second vial orienting unit 200. In the first embodiment of the medicine dispensing apparatus 1*a* explained above, the vial 10*a* was conveyed to the labeling unit 2*a* and labeled there with its posture standing, in other words with its opening facing upward. In the second embodiment of the medicine dispensing apparatus 1*b*, the vial 10*a* is conveyed to the labeling unit 2*b* and labeled there with its posture lying, in other words with its opening facing horizontally.

§ 2.2 Third Vial Orienting Unit

The third vial orienting unit 400 may orient the vial 10*a* such that it is lying down on a surface.

§ 2.2.1 First Embodiment of the Third Vial Orienting Unit

Figure 12:
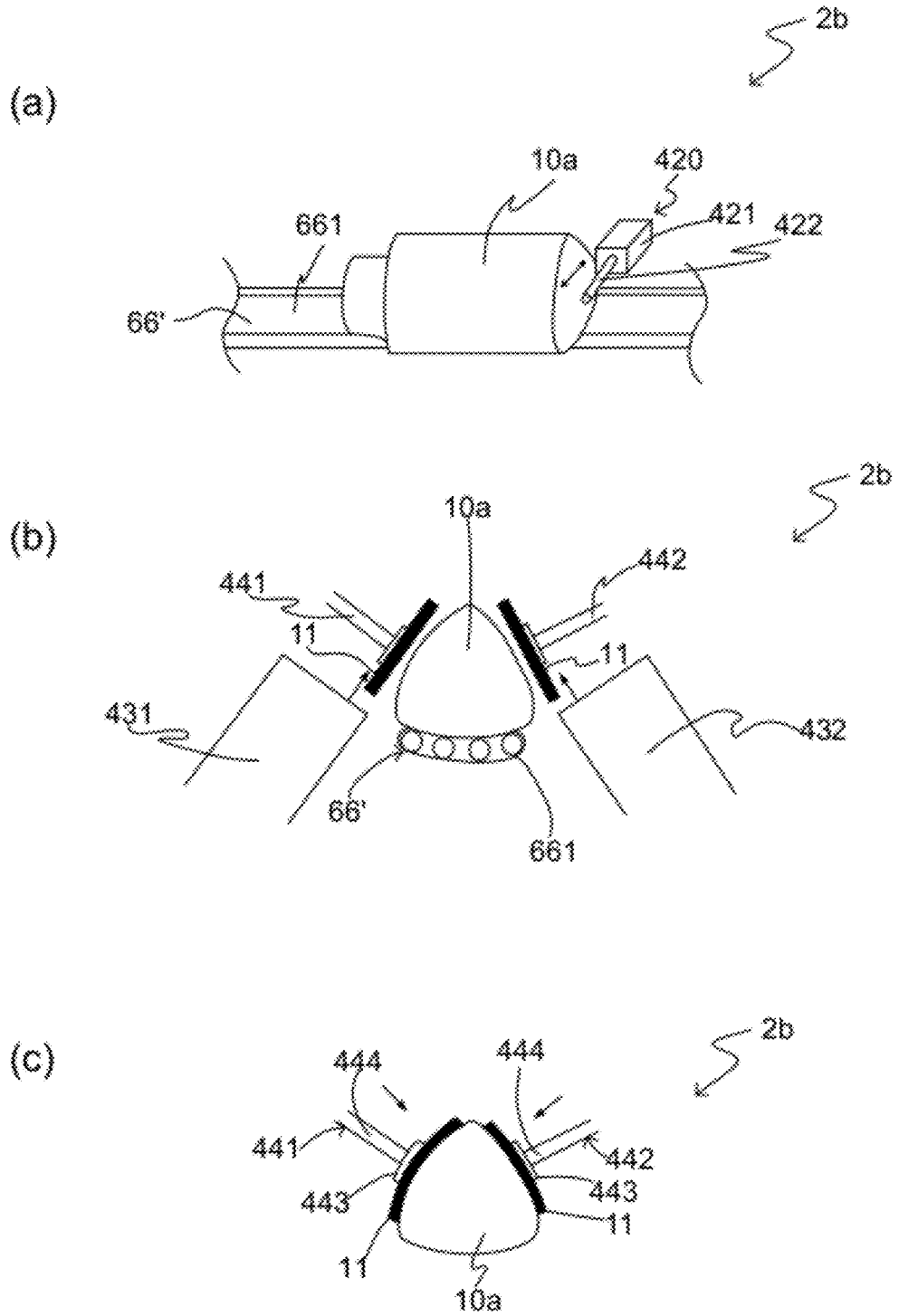
FIG. 12 is a schematic perspective and front views to explain the action of the third vial orienting unit and labeling unit.

FIGS. 11 & 12 illustrate a configuration of the third vial orienting unit 400. As shown in FIG. 11, the third vial orienting unit 400 contains a third conveyer 66' and a vial layer 411.

The vial layer 411 is provided over the third conveyer 66' at a height, which corresponds to an upper part of the vial 10*a*. The vial layer 411 has a down-facing surface descending in the conveying direction of the third conveyer 66'. The vial layer 411 falls and lays down the vial 10*a*.

As shown in FIG. 12, the third conveyer 66' contains a belt 661. The upper surface of the belt 661 is curved so that the center of the belt 661 is lower than the transverse end of the belt 661. The shape of the curve of the belt 661 corresponds to the shape of the curve of the edge portion of the lateral surface of the vial 10*a*. In other words, the curvature radius of the belt 661 of the conveyer 66' is approximately the same as the curvature radius of the edge portion of the lateral side of the vial 10*a*. In this respect, the curvature radius of the belt 661 is preferably at least 0.8 times and at most 1.2 times of the curvature radius of the edge portion of the vial 10*a*.

After placing the vial 10*a* on the fourth conveyer 110 (please refer FIG. 5) from the first vial orienting unit 100 using the vial erecting unit 65, the standing vial 10*a* is conveyed in the downstream direction by the fourth conveyer 110. In this case, the transverse orientation of the standing vial 10*a* is changed by the first vial orienting unit 100 so that one corner portion of the vial 10*a* approximately faces the conveying direction and the opposing edge portion of the vial 10*a* approximately faces the upstream direction. Next, the vial 10*a* enters the third conveyer 66' and further conveyed in the downstream direction by the belt 661. Eventually, the upper portion of the vial 10*a* hits the vial layer 411. Thereby, the vial 10*a* falls and lies down on the belt 661. Since the vial 10*a* is moving in the downstream direction, the vial 10*a* falls toward the upstream direction. In other words, the vial 10*a* is laid down so that the bottom of the vial 10*a* faces the conveying direction and the top of the vial 10*a* faces the upstream direction. Furthermore, since the corner portion of the vial 10*a* faces the conveying direction and the opposite edge portion faces the opposite direction, the corner portion of the vial 10*a* faces upward and the opposite edge portion faces downward and contacts with the belt 661 after lying. As shown in FIG. 12 (*b*), since the belt 661 is curved to fit to the edge potion of the vial 10*a*, the edge portion of the laid vial 10*a* engages with the belt 661. Therefore, the orientation of the vial 10*a* is stabilized and accurately determined. This laid vial 10*a* is conveyed to the labeling unit 2*b* by the third conveyer 66'.

§ 2.2.2 Third Embodiment of the Labeling Unit

As shown in FIG. 12, the labeling unit 2*b* contains a stopper 420, a first printer 431, a second printer 432, a first arm 441 and a second arm 442. The labeling unit 2*b* can label two edge portions of the lying vial 10*a* at the same time.

The stopper 420 contains a body 420 and a rod 422. The stopper 420 can prevent the vial 10*a* from moving in a downstream direction and precisely determine the upstream-downstream position of the vial 10*a*.

In this embodiment, the first printer 431 prints a first label 11 and feed the first label 11 to proximity of a first edge portion of the lateral surface of the vial 10*a*. Likewise, the second printer 432 prints a second label 11 and feed the second label 11 to proximity of a second edge portion of the lateral surface of the vial 10*a*. The exits of the labels 11 on the first printer 431 and the second printer 432 are located near the upper surface of the belt 661. More precisely speaking, the heights of the exits of the labels 11 on the first printer 431 and the second printer 432 are approximately the same as the height of the upper surface of the belt 661. Furthermore, the first printer 431 and the second printer 432 are configured to feed the labels 11 in directions approximately parallel to the edge portions of the vial 10*a*. In other words, the feeding directions of the labels 11 by the first printer 431 and the second printer 432 are preferably angled by 48°-72°, and more preferably approximately 60° from the horizontal direction.

The first arm 441 and the second arm 442 are located above the first printer 431 and the second printer 432 near the exits of labels 11. Each of the first arm 441 and the second arm 442 has an approximately T-shaped profile when seen from a plan view. Additionally, each of the first arm 441 and the second arm 442 has a contacting surface 443 and a shaft 444. Furthermore, the contacting surface 443 is provided approximately in parallel to the edge portion of the vial 10*a*. The angle formed by the contacting surface 443 and the horizontal plane is preferably about 48°-72°, and more preferably approximately 60°.

As shown in FIG. 12 (*a*), while the vial 10*a* is moving in the downstream direction by the third conveyer 66', the rod 422 comes out over the third conveyer 66' from the body 420. Then, the vial 10*a* touches the rod 422. Thereby, the movement of the vial 10*a* in the downstream direction is prevented and the position of the vial 10*a* is fixed. As shown in FIG. 12 (*b*), once the vial 10*a* reaches the predetermined position, the first printer 431 and the second printer 432 prints labels 11 and feed the printed labels right in front of the edge portions of the lateral surface of the vial 10*a*. Next, as shown in FIG. 12 (*c*), the first arm 441 and the second arm 442 respectively move in the longitudinal directions of the shafts 444. And, the contacting surfaces 443 presses the labels 11 onto the edge portions of the vial 10*a*. Thereby, the labels 11 are pasted on the vial 10*a*. After the vial 10*a* is labeled, the rod 422 pulls back out of the conveying path of the vial 10*a*. Thereby, the vial 10*a* begins to move in the conveying direction of the third conveyer 66' and gets out of the labeling unit 2*b*.

Figure 13:
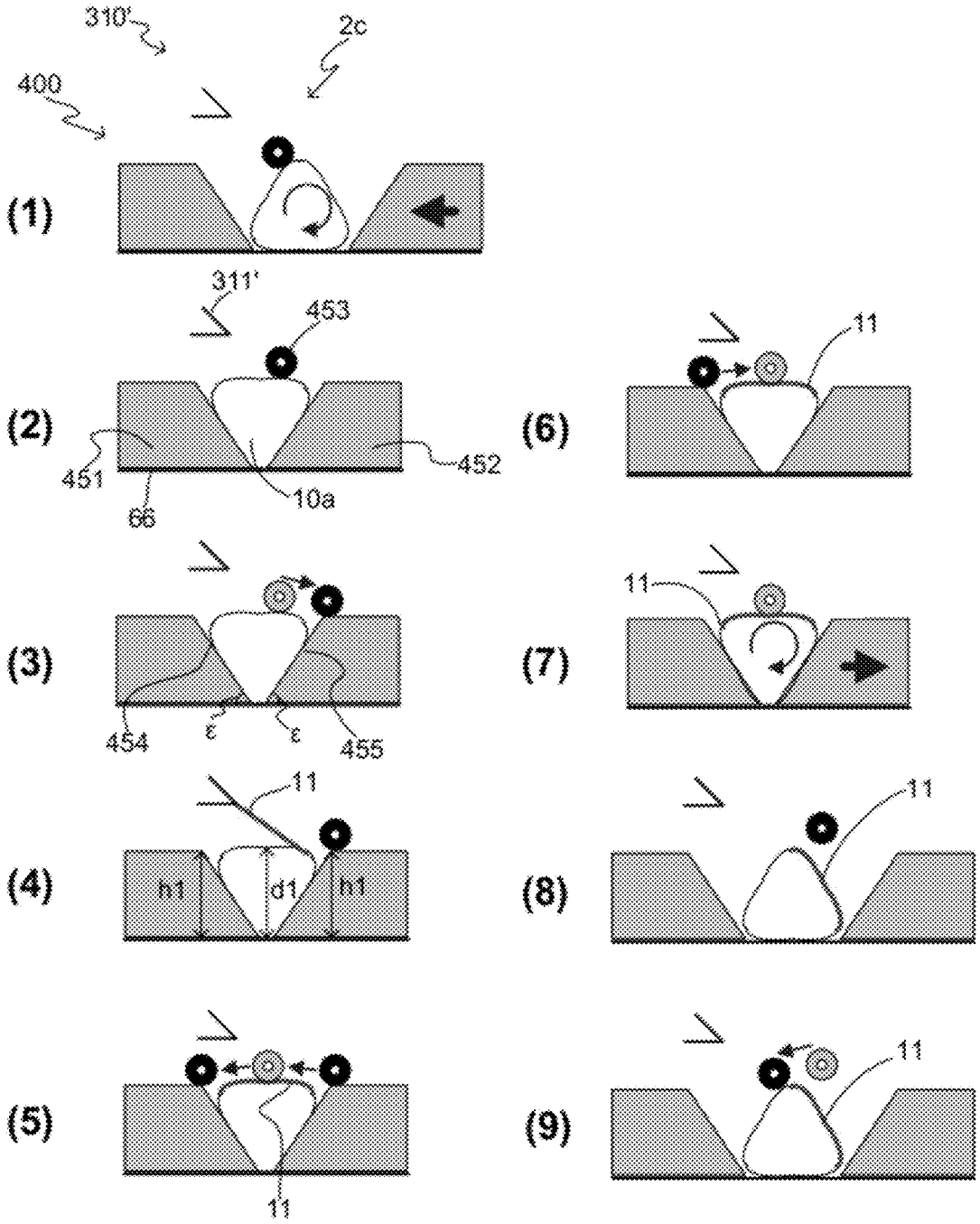
FIG. 13 is a schematic front view to explain the action of the third vial orienting unit and labeling unit.

§ 2.3 Second Embodiment of the Third Vial Orienting Unit and Fourth Embodiment of the Labeling Unit FIG. 13 shows a second embodiment of the third vial orienting unit 400 and a fourth embodiment of the labeling unit 2*c*. In this embodiment, the third vial orienting unit 400 is configured to orient the lying vial 10*a* before and while the labeling unit 2*c* is labeling the vial 10*a*. As shown in FIG. 13, the third vial orienting unit 400 contains a first vial support member 451 and a second vial support member 452 and a roller 453. Furthermore, the labeling unit 2*c* contains a label feeding device 310', which includes a guide flap 311' and the roller 453.

The first vial support member 451 and the second vial support member 452 are provided on or above the third conveyer 66. The first vial support member 451 and the second vial support member 452 coordinately support the vial 10*a* so that the vial 10*a* is held with one corner portion of the lateral surface of the vial 10*a* facing downward and one opposing edge portion facing upward. The first vial support member 451 and the second vial support member 452 are provided so that each member may face opposite to each other. On the other hand, the vial 10*a* is configured to be laid down between the first vial support member 451 and the second vial support member 452.

The first vial support member 451 and the second vial support member 452 contain a first sloping surface 454 and a second sloping surface 455. The first sloping surface 454 and the second sloping surface 455 are facing opposite to each other and placed symmetrically across a symmetrical plane, which is located in the middle of the first sloping surface 454 and the second sloping surface 455 and extends in the vertical direction. The first sloping surface 454 and the second sloping surface 455 are descending downwardly so that the gap between the first sloping surface 454 and the second sloping surface 455 becomes smaller as they go lower. The angle ε formed by the first sloping surface 454 or the second sloping surface 455 and the horizontal plane is preferably 48°-72°, and more preferably approximately 60°. The heights h1 of the first sloping surface 454 and the second sloping surface 455 are preferably at least 0.8 times and at most 1.2 times of the distance dl from one corner portion of the lateral surface of the vial 10*a* to the opposing edge portion of the vial 10*a*.

The roller 453 is provided near the upper end of the second sloping surface 455. The rotational axis of the roller 453 extends in the horizontal direction and in parallel to the longitudinal direction of the vial 10*a*. Furthermore, the rotational axis of the roller 453 is positioned above the upper end of the second sloping surface 455. The roller 453 is movable between the proximity of the upper end of the second sloping surface 455 and the proximity of the upper end of the first sloping surface 454. The roller 453 has two functions, one is to rotate the vial 10*a*, and the other one is to press the label 11 on the vial 10*a*.

The labeling unit 2*c* has a configuration similar to the configuration of labeling unit 2*a* shown in FIG. 7. However, the orientation of the labeling unit 2*c* is different from the orientation of the labeling unit 2*a*. While the labeling unit 2*a* is configured to feed the label 11 with its orientation parallel to the vertical direction, the labeling unit 2*c* is configured to feed the label 11 with its orientation perpendicular to the vertical direction. Furthermore, the upper surface of the guide flap 311', which provides a path for the label 11, is angled to the horizontal direction at a certain degree so that an assumed extension of the upper surface of the guide flap 311' passes near or above the corner portion of the lateral surface of the vial 10*a*.

As shown in FIG. 13 (1), the vial 10*a*, whose one edge portion is facing downward, is moved by the third conveyer 66 to the label feeding device 310'. Once the vial 10*a* is placed between the first vial support member 451 and the second vial support member 452, the roller 453 positions itself so that it contacts with a lateral surface of the vial 10*a* near the corner portion of the vial 10*a*. Also, the first vial support member 451 and the second vial support member 452 move toward the vial 10*a* so that the first vial support member 451 and the second vial support member 452 becomes close to the vial 10*a*.

Eventually, the lower portions of the first sloping surface 454 and the second sloping surface 455 touch the corner portions of the lateral surface of the vial 10*a*. And, the lower portions of the first sloping surface 454 and the second sloping surface 455 go under the vial 10*a*, lifting the vial 10*a* above the third conveyer 66. Coordinating with these movements, the roller 453 rotates and moves in the rotating direction of the vial 10*a*, facilitating the vial 10*a* to rotate around its longitudinal axis. As shown in FIG. 13 (2), eventually the vial 10*a* is rotated by 60°. In this way, a first edge portion of the vial 10*a* contacts with the first sloping surface 454 and a second edge portion of the vial 10*a* contacts with the second sloping surface 455. Furthermore, the corner portion of the lateral side of the vial 10*a* between the first edge portion and the second edge portion of the vial 10*a* faces downward. Thereby, the transverse orientation of the vial 10*a* is determined.

Next, as shown in FIG. 13 (3), the roller 453 moves off the vial 10*a*. Then, as shown in FIG. 13 (4), the label feeding device 310' feeds the label 11 onto the edge portion of the lateral surface of the vial 10*a* that is facing upward. Next, as shown in FIG. 13 (5), the roller 453 rotates and moves along the edge portion of the lateral surface of the vial 10*a* from one corner portion to another corner portion, pressing the label 11 onto the edge portion of the vial 10*a*. Thereby, the label 11 is pasted on one edge portion of the lateral surface of the vial 10*a*.

Next, as shown in FIG. 13 (6), the roller 453 moves and positions itself approximately at the middle of the edge portion of the lateral surface of the vial 10*a*, on which the label 11 was pasted. Then, as shown in FIG. 13 (7), the first vial support member 451 and the second vial support member 452 move away from the vial 10*a*. Coordinating with these movements, the roller 453 rotates and moves in the rotating direction of the vial 10*a*, facilitating the vial 10*a* to rotate around its longitudinal axis. As shown in FIG. 13 (8), eventually the vial 10*a* is rotated by 60°, forming approximately 60° of an angle between the labeled edge portion and the horizontal plane. Next, as shown in FIG. 13 (9), the roller 453 again positions itself so that it contacts with a lateral surface of the vial 10*a* near the corner portion of the vial 10*a*.

Then, the above-described process, shown in FIG. 13 (1)-(9), is repeated such that another label 11 is pasted on another edge portion of the lateral surface of the vial 10*a*.

Figure 14:
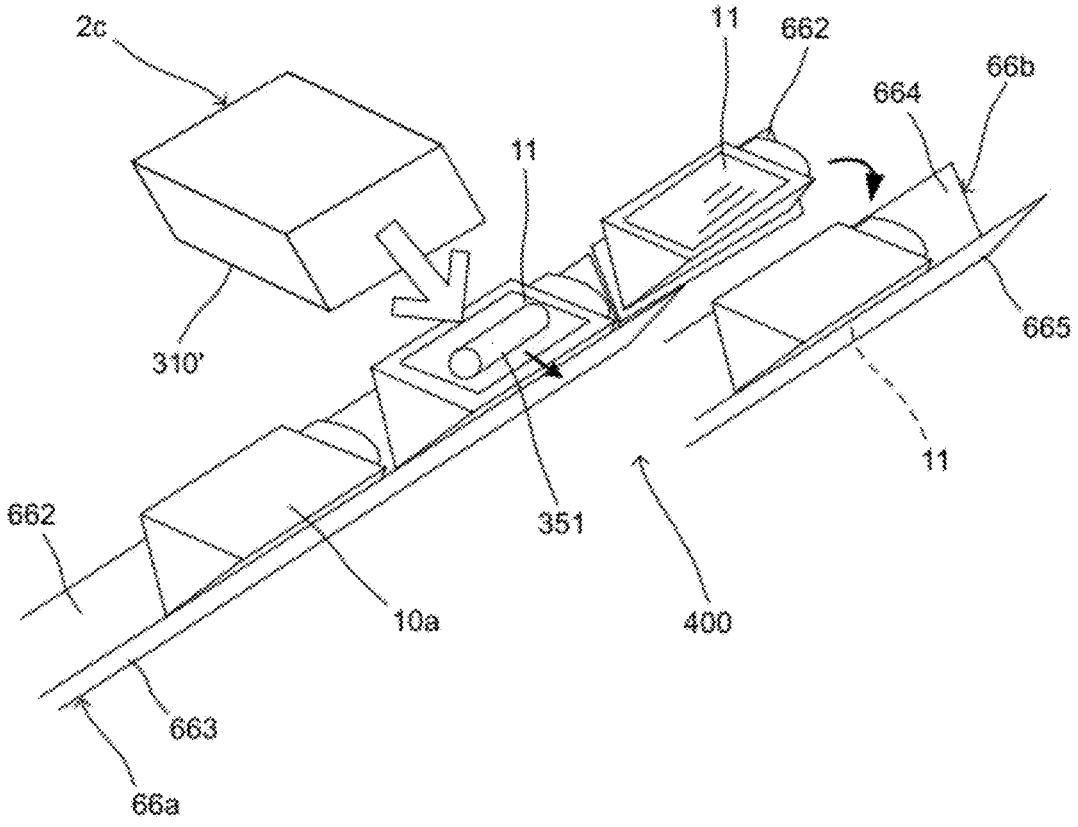
FIG. 14 is a schematic perspective view to explain the action of the third vial orienting unit and labeling unit.

§ 2.4 Third Embodiment of the Third Vial Orienting Unit and Fifth Embodiment of the Labeling Unit FIG. 14 shows a third embodiment of the third vial orienting unit 400 and a fourth embodiment of labeling unit 2*c*. As shown in this figure, the third vial orienting unit 400 contains a fifth conveyer 66*a* and a sixth conveyer 66*b*. Furthermore, the labeling unit 2*c* contains a label feeding device 310' and a roller 351.

The fifth conveyer 66*a* contains a first belt 662 and a second belt 663. The first belt 662 and the second belt 663 are provided next to each other so that the transverse cross-sectional shape of the fifth conveyer 66*a* forms a V-shape. The first belt 662 and the second belt 663 extend in the same direction. The first belt 662 and the second belt 663 are placed symmetrically across a symmetrical plane extending in the vertical direction and the longitudinal direction of the fifth conveyer 66*a*. The first belt 662 and the second belt 663 are placed so as to form an angle which is approximately the same as an internal angle of the corner portion of the lateral side of the vial 10*a*. The angle formed by the first belt 662 and the second belt 663 is preferably about 48°-72°, and more preferably about 60°. The first belt 662 is longer than the second belt 663. More specifically speaking, the downstream end portion of the first belt 662 is extending longer in the downstream direction than the downstream end portion of the second belt 663. The difference of the lengths between the first belt 662 and the second belt 663 is preferably at least half of the height of the vial 10*a*.

The sixth conveyer 66*b* is provided in adjacent to the fifth conveyer 66*a*. The sixth conveyer 66*b* is located at a place lower than where the fifth conveyer 66*a* is located. The conveying direction of the sixth conveyer 66*b* is the same as or opposite to the conveying direction of the fifth conveyer 66*a*. The sixth conveyer 66*b* contains a third belt 664 and a fourth belt 665. The third belt 664 is approximately parallel to the first belt 662. Furthermore, the first belt 662 and the third belt 664 are placed approximately on a same plane. The fourth belt 665 is approximately parallel to the second belt 663. The distance between the lower long end of the first belt 662 and the higher long end of the third belt 664 is preferably at most equal to the width of the edge portion of the lateral surface of the vial 10*a*. Upstream ends of the third belt 664 and the fourth belt 665 is provided near the downstream ends of the first belt 662 and the second belt 663. The distance between the downstream end of the first belt 662 and the upstream end of the third belt 664, in a plan view, is preferably at most twice of the height of the vial 10*a*. The relation of the third belt 664 and the fourth belt 665 is similar to the relation of the first belt 662 and the second belt 663.

The label feeding device 310' is provided near the fifth conveyer 66*a*. The label feeding device 310' feeds the printed label 11 onto the edge portion of the lateral surface of the vial 10*a* that is facing upward. The roller 351 presses the label 11 to paste the label 11 on the vial 10*a*.

The vial 10*a* is provided on the fifth conveyer 66*a* so that a first edge portion of the vial 10*a* contacts with the first belt 662, a second edge portion of the vial 10*a* contacts with the second belt 663, and a third edge portion of the vial 10*a* faces upward and a corner portion of the vial 10*a* opposing to the third edge portion faces downward. The vial 10*a* is conveyed in the downstream direction by the fifth conveyer 66*a*. When the vial 10*a* reaches a predetermined position, which is near the label feeding device 310', the fifth conveyer 66*a* stops. Then, the label 11 is provided on the third edge portion of the vial 10*a*. Next, the roller 351 rotates and moves along the third edge portion of the vial 10*a*. Thereby, the label 11 is pressed on the vial 10*a* and pasted on the third edge portion of the vial 10*a*. Then, the fifth conveyer 66*a* resumes conveying the vial 10*a*. Eventually, the vial 10*a* is conveyed to the downstream end portion of the fifth conveyer 66*a*. There, the vial 10*a* gets out of the second belt 663 and falls off from the fifth conveyer 66*a*. During falling, the vial 10*a* rotates by approximately 120° around a rotational axis extending in a longitudinal direction of the vial 10*a*. Then, the vial 10*a* reaches the sixth conveyer 66*b* with the pasted label 11 contacting to the fourth belt 665. Furthermore, the second edge portion of the vial 10*a*, which has not been labeled yet, faces upward. The vial 10*a* is conveyed in the downstream direction of the sixth conveyer 66*b* by the sixth conveyer 66*b*. Then, the second edge portion of the vial 10*a* is labeled by another labeling unit 2*c* (not shown in the drawing).

In an alternative embodiment, a door may be provided at the downstream end of the second belt 663. The door may be configured to open after the vial 10*a* reaches the door. In other embodiments, a protrusion may be provided on a surface between the first belt 662 and the third belt 664 to facilitate the rotation of the vial 10*a*.

§ 3. THIRD EMBODIMENT OF THE MEDICINE DISPENSING APPARATUS

§ 3.1 Overview of the Medicine Dispensing Apparatus

Figure 15:
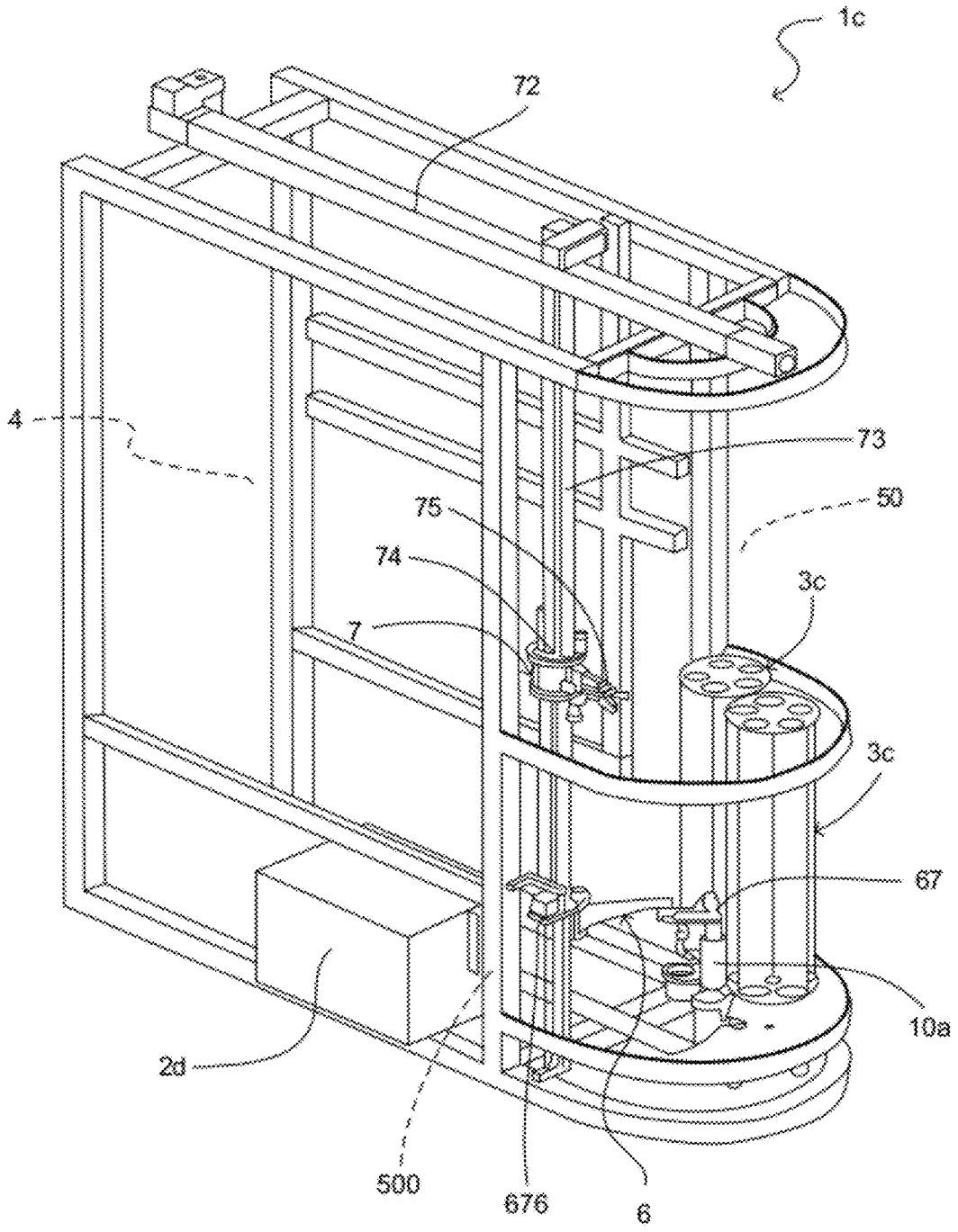
FIG. 15 is a perspective view of a third embodiment of the medicine dispensing apparatus, in which a cover and components near the cover are removed.

FIG. 15 shows an internal appearance of a third embodiment of the medicine dispensing apparatus. As shown in this figure, the medicine dispensing apparatus 1*c* contains a vial stocker 3*c*, a first vial transporting unit 6, a fourth vial orienting unit 500, a labeling unit 2*d*, a second vial transporting unit 7, a medicine filling unit 4, and a vial discharging windows 50.

The vial stocker 3*c* is provided in the lower and front portion of the medicine dispensing apparatus 1*c*. The vials 10*a* are vertically aligned in tandem in the vial stocker 3*c*. Each vial stocker 3*c* can stock various sizes of the vials. The labeling unit 2*d* is provided in the lower and middle portion of the medicine dispensing apparatus 1*c*. The medicine filling unit 4 is provided in the upper portion and lateral sides of the medicine dispensing apparatus 1*c*. The vial discharging windows 50 is provided in the upper portion and front side of the medicine dispensing apparatus 1*c*.

Once the user inputs a prescription datum and instructs the medicine dispensing apparatus 1*c* to dispense the prescribed medicines, the vial 10*a* having a proper size is selected and dispensed by the vial stocker 3*c*. Then, the vial 10*a* is transported by the first vial transporting unit 6 from the vial stocker 3*c* to the fourth vial orienting unit 500. There, the transverse orientation of the vial 10*a* is adjusted. Then, the vial 10*a* is labeled by the labeling unit 2*d*. The labeled vial 10*a* is transferred to the second vial transporting unit 7 by the first vial transporting unit 6. Then, the vial 10*a* is transported to the medicine filling unit 4 by the second vial transporting unit 7. There, the vial 10*a* is filled with the prescribed medicines. Lastly, the vial 10*a* is transported from the medicine filling unit 4 to the vial discharging window 50 and discharged out of the medicine dispensing apparatus 1*c* through the vial discharging window 50.

Figure 16:
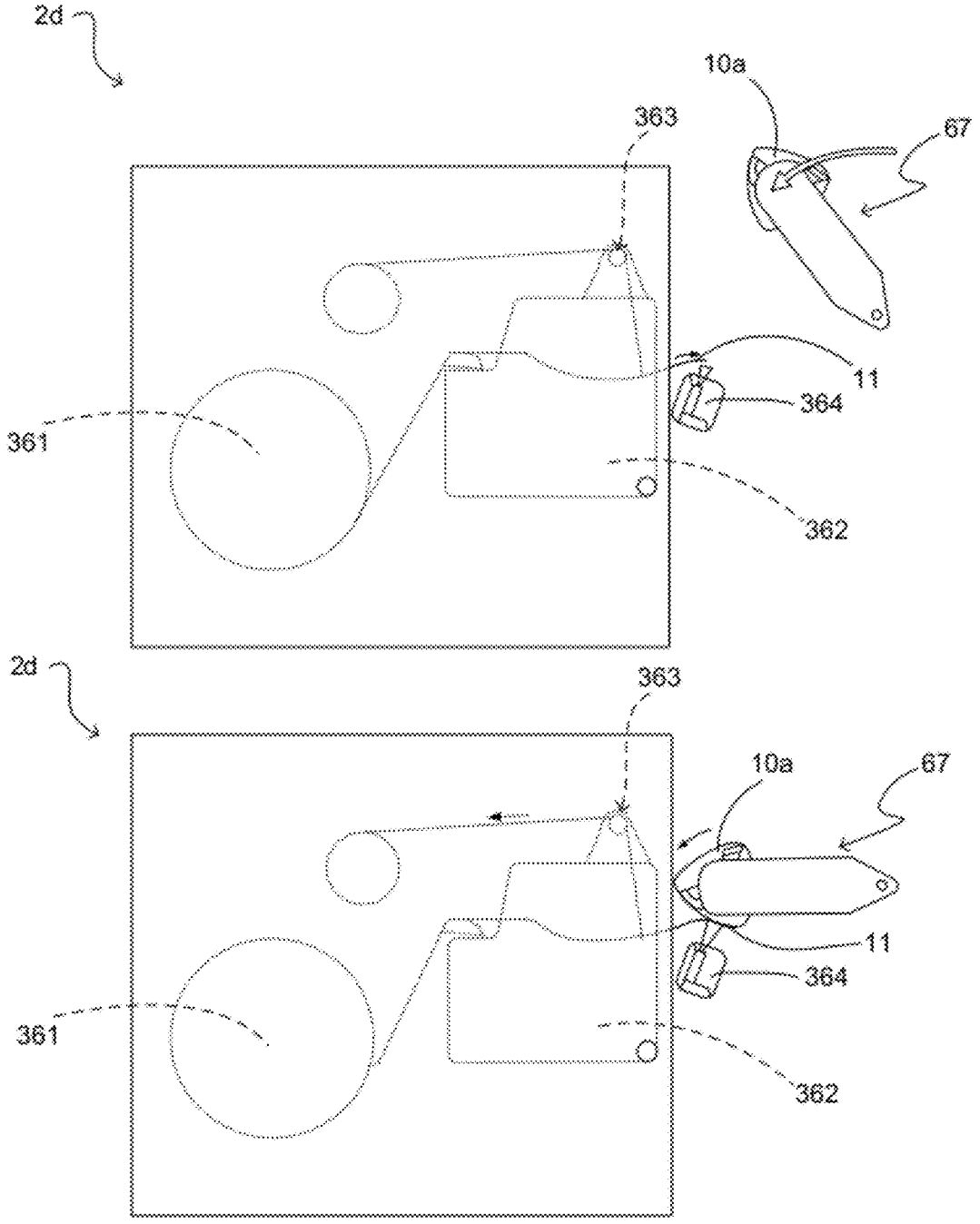
FIG. 16 is a schematic plan view of the labeling unit.

As shown in FIG. 16, the labeling unit 2*d* contains a label feeder 361, a printer 362, a release-paper peeler 363 and a label presser 364. The label 11 fed by the label feeder 361 is printed by the printer 362. Then, the release paper attached on the backside of the label 11 is peeled and wound by the release-paper peeler 363. The printed label 11 exits the body of the labeling unit 2*c* and fed onto the edge portion of the lateral surface of the vial 10*a*. The label presser 364 presses the label 11 onto the edge portion. Thereby, the label 11 is pasted on the vial 10*a*.

Referring back to FIG. 15, the second vial transporting unit 7 contains a horizontal rail 72, a vertical rail 73, a vertically moving unit 74, and a gripping device 75. The horizontal rail 72 extends in frontward-backward directions of the medicine dispensing apparatus 1*c*. The vertical rail 73 extends in upward-downward directions and is coupled to the horizontal rail 72. The vertically moving unit 74 is coupled to the vertical rail 73. The gripping device 75 is coupled to the vertically moving unit 74. The gripping device 75 receives the vial 10*a* from the first vial transporting unit 6 and holds the vial 10*a*. The vertically moving unit 74 moves the gripping device 75 in upward-downward directions. Furthermore, the vertical rail 73 moves along the horizontal rail 72 in frontward-backward directions. Thereby, the vial 10*a* is transported from the first vial transporting unit 6 to a place where the prescribed medicines are stored. Furthermore, the vial 10*a* is transported from the medicine filling unit 4 to the vial discharging window 50.

§ 3.2 First Vial Transporting Unit and Vial Rotating Unit

Figure 17:
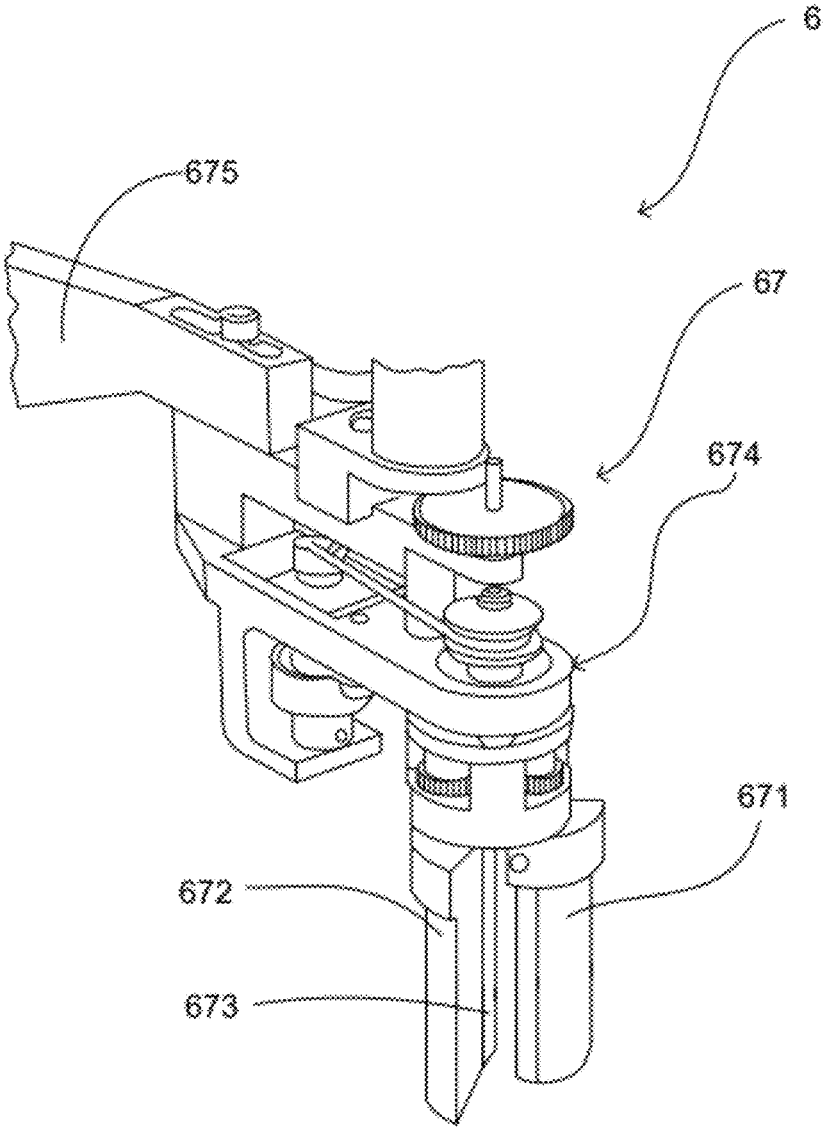
FIG. 17 is a perspective view of a first embodiment of the first vial transporting unit.

§ 3.2.1 First Embodiments of the First Vial Transporting Unit and Vial Rotating Unit The first vial transporting unit 6 transports the vial 10*a* from the stocker 3*c* to the labeling unit 2*d*. Furthermore, the first vial transporting unit 6 can rotate the vial 10*a* around the rotational axis extending in the longitudinal direction of the vial 10*a* and passing approximately the center of the vial 10*a*. As shown in FIG. 17, the first vial transporting unit 6 contains a gripping device 67, a support member 675, and a swing unit 676 (please refer to FIG. 15). The gripping device 67 contains a first arm 671, a second arm 672, a third arm 673, and a driving unit 674.

The first arm 671, the second arm 672 and the third arm 673 extend in the vertical direction. The first arm 671, the second arm 672 and the third arm 673 are placed so as to form angles of approximately 120° with respect to each other in a plan view. The first arm 671, the second arm 672 and the third arm 673 are coupled to the driving unit 674. The driving unit 674 opens and closes the first arm 671, the second arm 672 and the third arm 673. Thereby, the inner wall of the vial 10*a* is pressed by the first arm 671, the second arm 672 and the third arm 673. Thus, the vial 10*a* is gripped by the gripping device 67. Furthermore, the driving unit 674 rotates the first arm 671, the second arm 672 and the third arm 673 around the rotational axis, which is located approximately at a center position surrounded by the first arm 671, the second arm 672 and the third arm 673, and which extends in the vertical direction. Thereby, the vial 10*a* is rotated. Accordingly, the gripping device 67 constitutes one embodiment of the vial rotating unit.

The driving unit 674 is supported by the support member 675. The support member 675 is coupled to the swing unit 676. The swing unit 676 swings the support member 675 so that the gripping device 67 goes back and forth between the vial stocker 3*c* and the labeling unit 2*d*.

§ 3.2.2 Second Embodiment of the First Vial Transporting Unit

Figure 18:
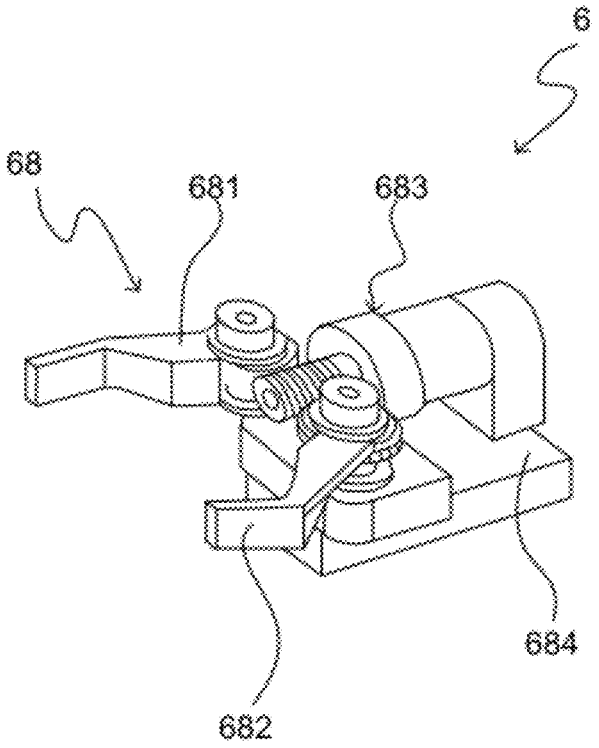
FIG. 18 is a perspective view of a second embodiment of the first vial transporting unit.

FIG. 18 shows the second embodiment of the first vial transporting unit 6. As shown in this figure, the first vial transporting unit 6 contains a gripping device 68, a support member 684, and a swing unit 676 (please refer to FIG. 15). The gripping device 68 contains a first arm 681, a second arm 682, and a driving unit 683.

The first arm 681 and the second arm 682 are coupled to the driving unit 683. The driving unit 683 opens and closes the first arm 681 and the second arm 682. Thereby, the outer surface of the vial 10*a* is pressed by the first arm 681 and the second arm 682. And, the vial 10*a* is gripped by the gripping device 68.

The driving unit 683 is supported by the support member 684. The support member 684 is coupled to the swing unit 676 (please refer to FIG. 15). The swing unit 676 swings the support member 684 so that the first arm 681 and the second arm 682 go back and forth between the vial stocker 3*c* and the labeling unit 2*d*.

§ 3.2.3 Second Embodiment of the Vial Rotating Unit

Figure 19:
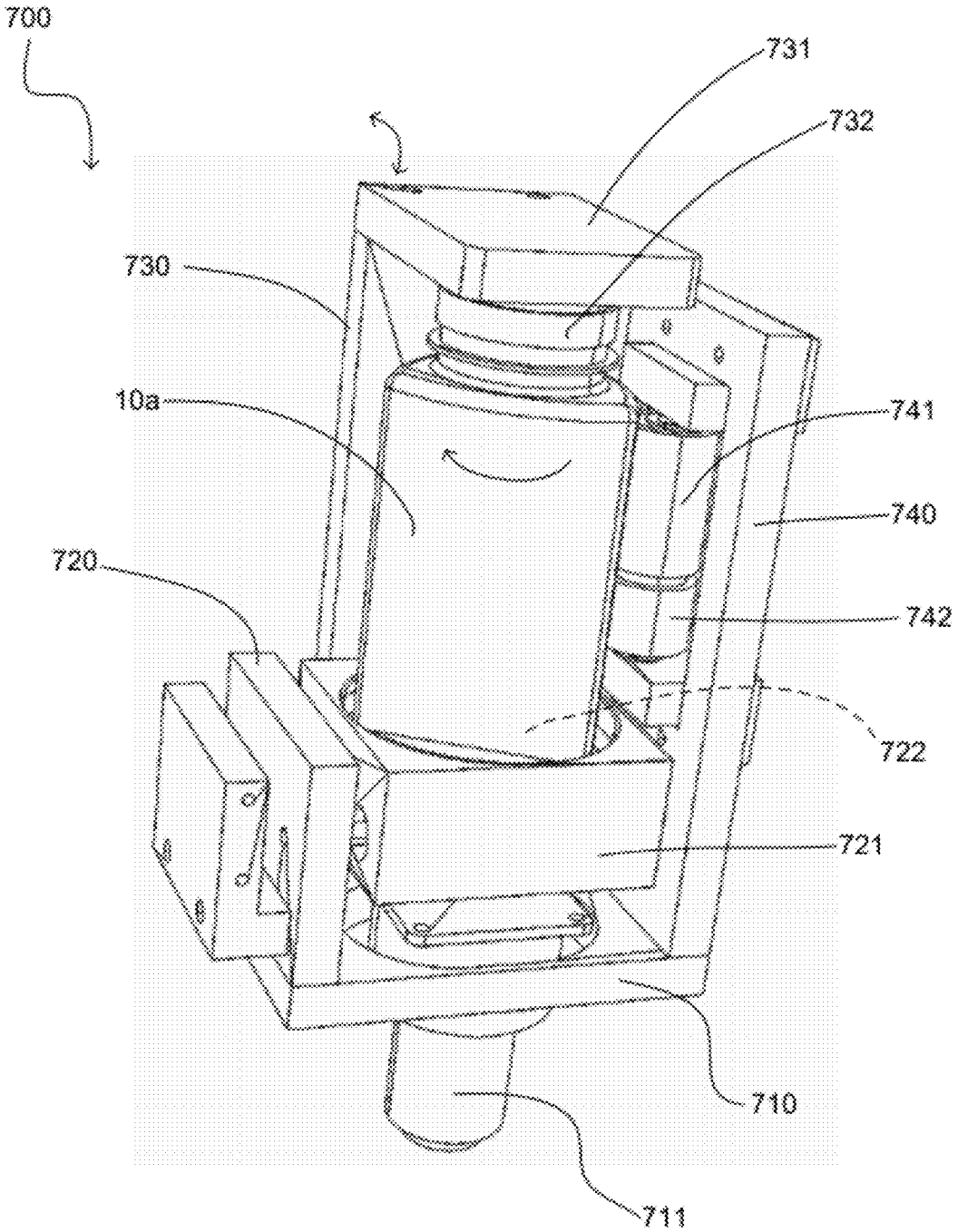
FIG. 19 is a perspective view of a second embodiment of the vial rotating unit.

FIG. 19 shows the second embodiment of the vial rotating unit 700. The vial rotating unit 700 is provided near the labeling unit 2*d* in front of the exit of the label 11. The vial rotating unit 700 can rotate the vial 10*a* around the rotational axis extending in the longitudinal direction of the vial 10*a* and passing approximately the center of the vial 10*a*. As shown in FIG. 19, the vial rotating unit 700 contains a base member 710, a first wall 720, a second wall 730, and a third wall 740. The vial rotating unit 700 also contains a base-rotating unit 711, a tray 721, a mouth holder 731, a first roller 741 and a second roller 742.

The base member 710 has a rectangular plan view shape and is placed horizontally. On a first edge of the base member 710, the first wall 720 is connected, which is placed vertically. The tray 721 is coupled to the first wall 720. The tray 721 has a square plan view shape and is placed horizontally. On the tray 721, a rotational table 722 is horizontally provided. The height of the upper surface of the rotational table 722 is positioned lower than the height of the upper surface of the tray 721. The rotational table 722 has a circular plan view shape and is freely rotatable around the rotational axis, which extends in the vertical direction and passes through the center of the rotational table 722. The vial 10*a* is configured to be placed on the rotational table 722 so that the bottom surface of the vial 10*a* is in contact with the rotational table 722.

On a second edge of the base member 710, which is perpendicular to the first edge, the second wall 730 is connected. The second wall 730 is placed vertically. The height of the second wall 730 is higher than the height of the first wall 720. The difference between the heights of the first wall 720 and the second wall 730 is preferably larger than the height of the vial 10*a*. Furthermore, the height of the second wall 730 is preferably higher than the height of the vial 10*a*.

On the upper end of the second wall 730, the mouth holder 731 is provided. The mouth holder 731 holds the upper portion of the vial 10*a*. The mouth holder 731 can rotate by 90° around the rotational axis extending in the horizontal direction and parallel to the second wall 730. In other words, the mouth holder 731 can change its orientation between a vertical orientation and a horizontal orientation. The mouth holder 731 contains an engaging piece 732, which protrudes downwardly when the mouth holder 731 orients horizontally. The engaging piece 732 has a circular plan view shape and has a diameter smaller than the diameter of the opening of the vial 10*a*. The engaging piece 732 is freely rotatable around the rotational axis extending in the direction perpendicular to the mouth holder 731 and passing the center of the engaging piece 732. When the mouth holder 731 lies down, the engaging piece 732 engages with the neck portion of the vial 10*a*. This prevents the vial 10*a* from moving except rotating horizontally. Furthermore, when the mouth holder 731 lies down, the rotational axis of the engaging piece 732 corresponds to the rotational axis of the rotational table 722. In addition, when the mouth holder 731 and the rotational table 722 rotate simultaneously, the rotational axis of the vial 10*a* matches with the center of gravity of the vial 10*a*. Therefore, the rotational axes of the engaging piece 732, the rotational table 722 and the vial 10*a* and the center of gravity of the vial 10*a* match with one another when the vial 10*a* rotates.

On a third edge of the base member 710, which is perpendicular to the second edge, the third wall 740 is connected. The third wall 740 is placed vertically. The height of the third wall 740 is approximately the same as the height of the second wall 730.

On the third wall 740, the first roller 741 and the second roller 742 are provided. The first roller 741 and the second roller 742 are aligned in tandem and placed vertically. In other words, the rotational axes of the first roller 741 and the second roller 742 extend in the vertical direction. The first roller 741 and the second roller 742 can rotate the vial 10*a* and are configured to be placed at a position closer to the third wall 740 when the mouth holder 731 is open. The first roller 741 and the second roller 742 are configured to go away from the third wall 740 in coordination with the closure of said mouth holder 731. Furthermore, the first roller 741 and the second roller 742 are biased toward the center of the vial rotating unit 700. Therefore, even when the vial 10*a* rotates and the distance from the third wall 740 to the lateral surface of the vial 10*a* increases, the first roller 741 and the second roller 742 are keeping contact with the lateral surface of the vial 10*a* and rotating the vial 10*a*.

The base-rotating unit 711 is coupled to the bottom side of the base member 710. The base-rotating unit 711 can rotate the base member 710 horizontally.

In other embodiment, the tray 721 may be configured to lift in the upward direction after the vial 10*a* is placed on the tray 721. In yet another embodiment, the mouth holder 731 may be configured to move downwardly after the vial 10*a* is placed on the tray 721. In an alternative embodiment, the engaging piece 732 may be configured to be driven to rotate. In yet another embodiment, the vial rotating unit 700 may be incorporated in the second vial orienting unit 200 of the first embodiment of the medicine dispensing apparatus 1*a*. The vial rotating unit 700 is optimally placed at the downstream end of the conveyer.

Once the gripping device 68, shown in FIG. 18, brings the vial 10*a* on the rotational table 722, the mouth holder 731 closes. Thereby, the position of the vial 10*a* can be fixed. Next, the vial 10*a* is rotated by the first roller 741 and the second roller 742. The rotation of the first roller 741 and the second roller 742 is stopped when the vial 10*a* is judged to be precisely placed in a predetermined orientation by the vial orientation detection unit or by the vial orientation determining unit, which will be described further below. Accordingly, in this embodiment, the vial orienting unit is constituted with the gripping device 67 or the vial rotating unit 700 and the vial orientation detection unit or the vial orientation determining unit described below.

§ 3.3 Vial Orientation Detection Unit

The vial orientation detection unit is provided near the labeling unit 2*d* or the vial rotating unit 700 so that the vial orientation detection unit may detect the transverse orientation of the vial 10*a*, being rotated by the gripping device 67 or the vial rotating unit 700.

§ 3.3.1 First Embodiment of the Vial Orientation Detection Unit

Figure 20:
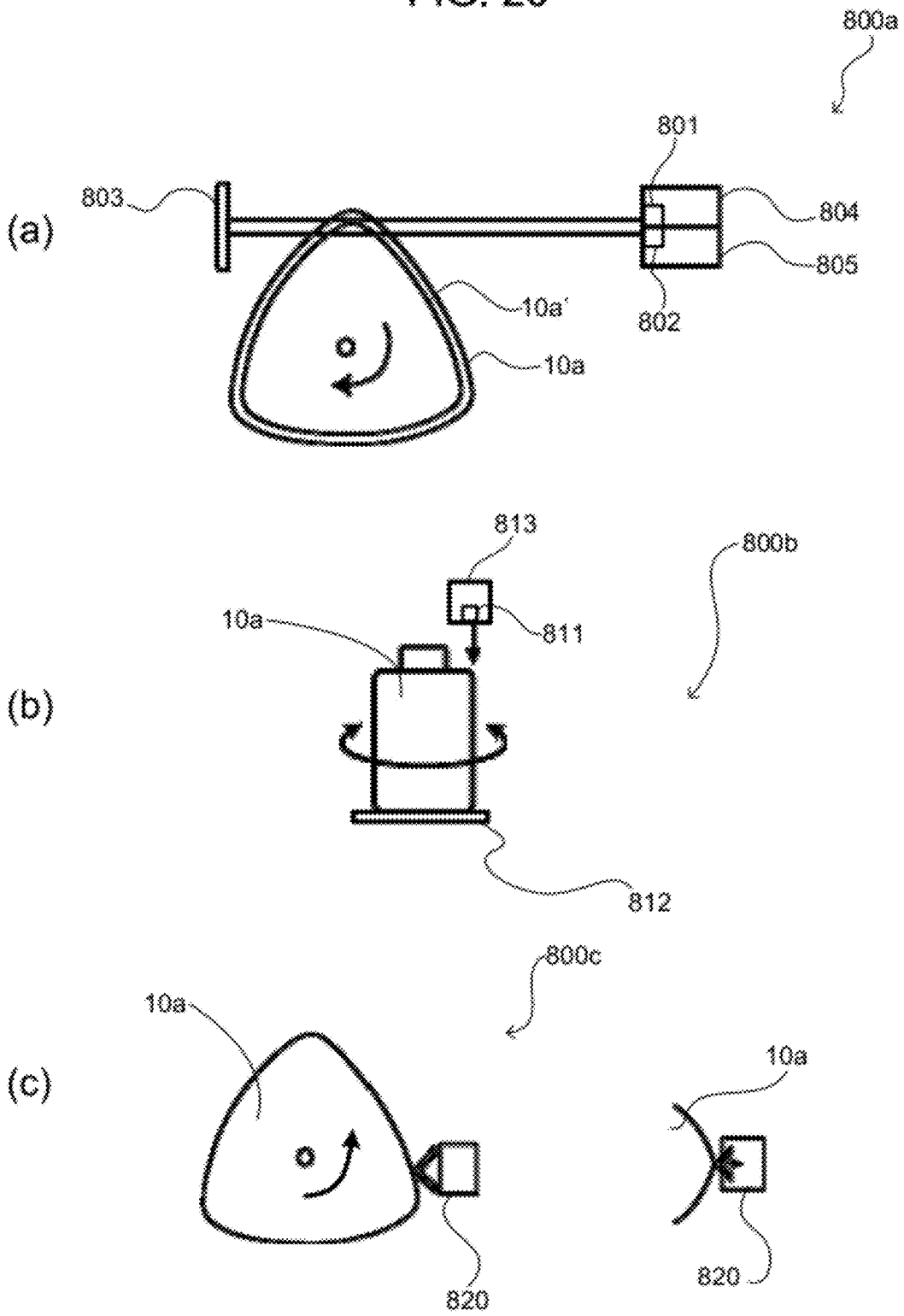
FIG. 20 is a schematic plan and side views to explain the vial orientation detection unit.

FIG. 20 (*a*) shows the first embodiment of the vial orientation detection unit 800*a*. The vial orientation detection unit 800*a* contains a first light source 801, a second light source 802, a mirror (reflector) 803, a first light detector 804 and a second light detector 805.

The first light source 801, the second light source 802, the first light detector 804 and the second light detector 805 are provided at a same side. The mirror 803 is provided so that the mirror 803 faces opposite to the first light source 801, the second light source 802, the first light detector 804 and the second light detector 805 approximately across the vial 10*a* or 10*a*′.

The first light source 801 and the second light source 802 are composed of light emitting devices that emit a directive beam, such as laser light emitting diode. Furthermore, the first light source 801 and the second light source 802 are arranged so that optical paths of the lights emitted by the first light source 801 and the second light source 802 passes through the corner portion of the lateral surface of the vial 10*a* or 10*a*' when the corner portion is placed at a position which is closest to the optical path. In this embodiment, the optical path is arranged so that it is perpendicular to the rotational axis of the vial 10*a* or 10*a*'.

It is also preferable that the optical path is perpendicular to a line which connects the corner portion of the vial 10*a* or 10*a*' to the center of gravity of the vial 10*a* or 10*a*', when the corner portion is placed at a position which is the closest to the optical path. Furthermore, it is preferable that a length of a normal line, placed between the optical path and the center of gravity of the vial 10*a* or 10*a*', be shorter than the line which connects the corner portion of the vial 10*a* or 10*a*' to the center of gravity of the vial 10*a* or 10*a*'. In addition, it is preferable that a length of a normal line, placed between the optical path and the center of gravity of the vial 10*a* or 10*a*', be longer than the line which connects the middle point of the edge portion of the vial 10*a* or 10*a*' to the center of gravity of the vial 10*a* or 10*a*'. In this respect, the length of the normal line placed between the optical path and the center of gravity of the vial 10*a* or 10*a*' is preferably larger than $\sqrt{3}/6$ of the width of the edge portion of the vial 10*a* or 10*a*' and smaller than $\sqrt{3}/3$ of the width of the edge portion of the vial 10*a* or 10*a*' when seen from a plan view.

In a case where the edge portion of the lateral surface of the vial 10*a* or 10*a*' is closer to the optical path, the light emitted by the first light source 801 or the second light source 802 is not blocked by the vial 10*a* or 10*a*' because the edge portion cannot be located on the optical path. Therefore, the light reaches the mirror 803. Next, the light is reflected by the mirror 803. The reflected light is detected by the first light detector 804 or the second light detector 805. As the vial 10*a* or 10*a*' rotates and when the corner portion of the lateral surface of the vial 10*a* or 10*a*' reaches the optical path, the light is blocked by the vial 10*a* or 10*a*'. Therefore, the emitted light is not detected by the first light detector 804 or the second light detector 805. Therefore, the transverse orientation of the vial 10*a* or 10*a*' may be detected as the corner portion of the vial 10*a* or 10*a*' is located on the optical path.

In this embodiment, the second light source 802 is placed at a position which is closer to the rotational axis of the vial 10*a* or 10*a*' than the position at which the first light source 801 is placed. In other words, the length of the normal line between the optical path formed by the first light source 801 and the center of gravity of the vial 10*a* or 10*a*' is longer than the length of the normal line between the optical path formed by the second light source 802 and the center of gravity of the vial 10*a* or 10*a*'. With this configuration, the vial orientation detection unit 800*a* can detect the orientations of different sizes of the vials 10*a* and 10*a*'. In the case of FIG. 20 (*a*), the vial 10*a*' is smaller than the vial 10*a*. When the corner portion of the vial 10*a*' reaches the optical path formed by the second light source 802, the absence of the emitted light is detected by the second light detector 805. On the other hand, the presence of the emitted light may be still detected by the first detector 804. Accordingly, the second light detector 805 is suitable for detecting the corner portion of the vial 10*a*'. When the corner portion of the vial 10*a* reaches the optical path formed by the first light source 801, the absence of the emitted light is detected by both the first light detector 804 and the second light detector 805. However, since the first light detector 804 is located farther from the vial 10*a* than the second light detector 805, the absence of the emitted light may be detected later. Accordingly, the first light detector 804 is suitable for a more accurate detection of the corner portion of the vial 10*a*.

In other embodiments, instead of the mirror 803, a reflective plate or other kind of reflectors may be used to reflect the light emitted from the first light source 801 or the second light source 802.

§ 3.3.2 Second Embodiment of the Vial Orientation Detection Unit

In the embodiment shown in FIG. 20 (*b*), the vial orientation detection unit 800*b* contains a light source 811, a mirror 812, and a light detector 813. The light source 811 and the light detector 812 are provided above the vial 10*a* while the mirror 812 is provided below the vial 10*a*. In this embodiment, the optical path is arranged so that it is parallel to the rotational axis of the vial 10*a*. The basic configuration and mechanism used in the vial orientation detection unit 800*b* for detecting the position of the corner portion of the lateral surface of the vial 10*a* is the same as those explained in the case of the vial orientation detection unit 800*a*.

§ 3.3.3 Third Embodiment of the Vial Orientation Detection Unit

In the embodiment shown in FIG. 20 (*c*), the vial orientation detection unit 800*c* contains a switch (micro switch) 820. The switch 820 is provided near and in front of the lateral surface of the vial 10*a*. Furthermore, the switch 820 is placed at a position where the corner portion of the lateral surface of the vial 10*a* can touch the switch 820 but the edge portion of the lateral surface of the vial 10*a* cannot touch the switch 820. This is when the vial 10*a* is rotating around the rotational axis extending in the longitudinal direction of the vial 10*a*.

It is preferable that the distance from the switch 820 to the rotational axis of the vial 10*a* is smaller than the distance from the corner portion of the vial 10*a* to the center of gravity of the vial 10*a*. In addition, it is preferable that the distance from the switch 820 to the rotational axis of the vial 10*a* is larger than the distance from the middle point of the edge portion of the vial 10*a* to the center of gravity of the vial 10*a*. In this respect, the distance from the switch 820 to the rotational axis of the vial 10*a* is preferably larger than $\sqrt{3}/6$ of the width of the edge portion of the vial 10*a* and smaller than $\sqrt{3}/3$ of the width of the edge portion of the vial 10*a* as seen in a plan view.

In a case where the edge portion of the lateral surface of the vial 10*a* is near the switch 820, said edge portion does not touch the switch 820. Therefore, the switch 820 is maintained OFF. As the vial 10*a* rotates, the corner portion of the vial 10*a* approaches to the switch 820. And, the distance from the lateral surface of the vial 10*a* to the switch 820 becomes closer and closer. As shown in the right portion of FIG. 20 (*c*), when the corner portion of the vial 10*a* reaches the switch 820, the lateral surface of the vial 10*a* comes into contact with the switch 820 and thus presses the switch 820. Therefore, the switch 820 becomes ON. Thus, it is detected that the corner portion of the lateral surface of the vial 10*a* is located by the switch 820 and the vial 10*a* is orienting in a certain transverse direction of the vial 10*a*.

§ 3.3.4 Fourth Embodiment of the Vial Orientation Detection Unit

Figure 21:
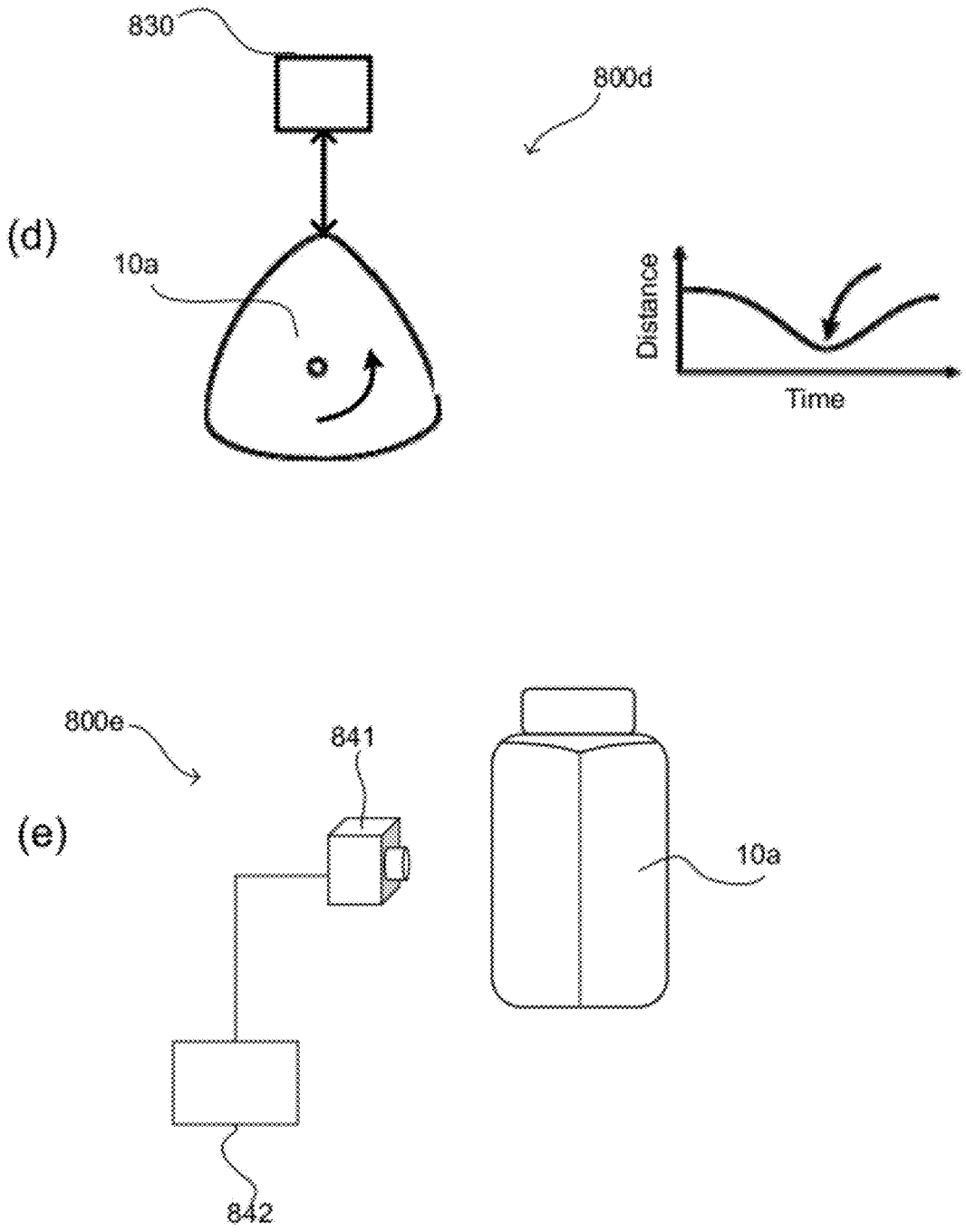
FIG. 21 is a schematic plan and side views to explain the vial orientation detection unit.

In the embodiment shown in FIG. 21 (*d*), the vial orientation detection unit 800*d* contains a distance sensor 830. The distance sensor 830 is provided at a place distant from the vial 10*a* by a certain distance. Furthermore, the distance sensor 830 is provided so that it faces opposite to the lateral surface of the vial 10*a*. The distance sensor 830 is for example composed of an ultrasonic wave oscillator and an ultrasonic sensor. The distance sensor 830 can measure the period of time from the time when the ultrasonic waves are emitted by the ultrasonic wave oscillator up until the time when the ultrasonic waves are reflected by the lateral surface of the vial 10*a* and reach the ultrasonic sensor. This period of time corresponds to the distance between the distance sensor 830 and the lateral surface of the vial 10*a*.

Once the vial 10*a* rotates at a constant angular velocity, the distance from the distance sensor 830 to the lateral surface of the vial 10*a* oscillates as if it draws a sine curve as shown in the right portion of FIG. 21. It should be noted that when the distance is the shortest, the rotation of the vial 10*a* is stopped. At that time, the corner portion of the lateral surface of the vial 10*a* is facing the distance sensor 830. Thereby, the transverse orientation of the vial 10*a* is detected.

§ 3.3.5 Fifth Embodiment of the Vial Orientation Detection Unit

In the embodiment shown in FIG. 21 (*e*), the vial orientation detection unit 800*e* contains a camera 841 and a computer 842. The camera 841 is, for example, composed of a CCD camera, a digital camera or an infrared camera that takes pictures of the vial 10*a*. In the case of FIG. 21 (*e*), the camera 841 is placed in front of the vial 10*a* so that the camera 841 faces opposite to the lateral surface of the vial 10*a* and takes pictures of a side view of the vial 10*a*.

The computer 842 is coupled to the camera 841. The computer 842 internally stores a reference picture of the side view of the vial 10*a*, in which the corner portion of the vial 10*a* is facing to the camera 841. The computer 842 performs a pattern matching between the picture taken by the camera 841 and the reference picture stored in the computer. In other words, the computer compares the two pictures and determines if the picture taken presently by the camera 841 matches the reference picture stored in the computer. When the two pictures match, it is determined that the corner portion of the vial 10*a* is facing to the camera 841. Thereby, the transverse orientation of the vial 10*a* is detected.

In some embodiments, the vial orientation detection unit 800*e* may be configured to detect the timing when the edge portion of the lateral surface of the vial 10*a* is facing opposite to the camera 841. In other embodiments, the camera 841 may be placed above or below the vial 10*a* so that the camera 841 takes pictures of top views or bottom views of the vial 10*a*.

§ 3.4 Vial Orientation Determining Unit

The vial orientation determining unit can be provided near the labeling unit 2*d* or the vial rotating unit 700 instead of the vial orientation detection unit. The vial orientation determining unit can mechanically determine the transverse orientation of the vial 10*a* being rotated by the gripping device 67 or the vial rotating unit 700.

§ 3.4.1 First Embodiment of the Vial Orientation Determining Unit

Figure 22:
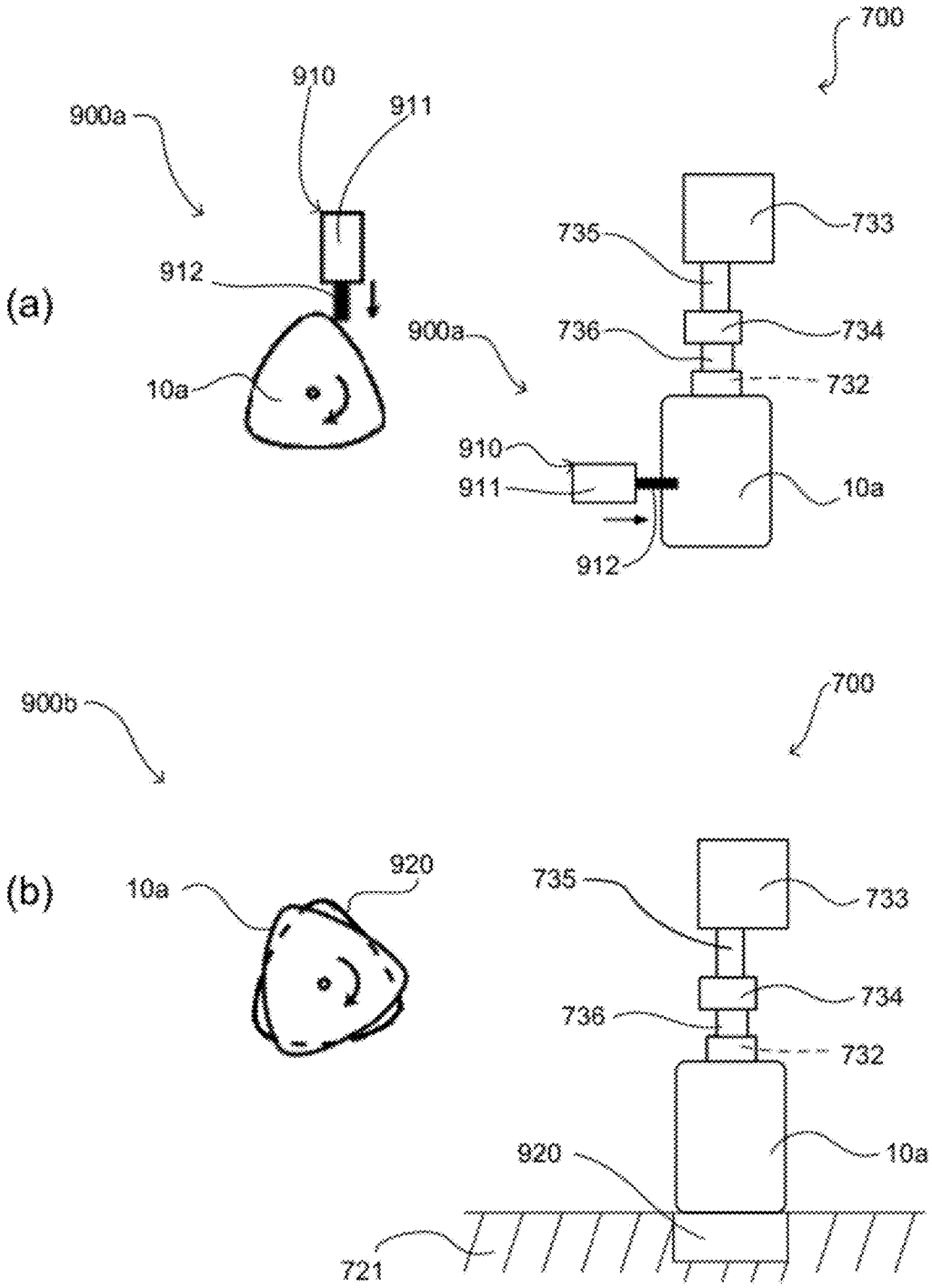
FIG. 22 is schematic plan and side views to explain the vial orientation determining unit.

In the embodiment shown in the left portion of FIG. 22 (*a*), the vial orientation determining unit 900*a* contains a stopper 910, which has a body 911 and a rod 912. The vial orientation determining unit 900*a* is provided near the vial 10*a* in front of the lateral surface of the vial 10*a*. The rod 912 is supported by the body 911 and configured to move toward or away from the lateral surface of the vial 10*a*. When the rod 912 is elongated, the front end of the rod 912 may contact with the lateral surface of the vial 10*a* at a predetermined position such as, for example, at or near the corner portion of the vial 10*a*. However, the rod 912 is not long enough to touch the position which is closer to the middle of the edge portion of the vial 10*a*. When the rod 912 is shortened, the front end of the rod 912 is distant from any position on the lateral surface of the vial 10*a*.

At the elongated state, it is preferable that the distance from the front end of the rod 912 to the rotational axis of the vial 10*a* is smaller than the distance between the corner portion of the vial 10*a* and the center of gravity of the vial 10*a*. In addition, it is preferable that the distance from the front end of the rod 912 to the rotational axis of the vial 10*a* is larger than the distance between the middle point of the edge portion of the vial 10*a* and the center of gravity of the vial 10*a*. In this respect, the distance from the front end of the rod 912 to the rotational axis of the vial 10*a* is preferably larger than $\sqrt{3}/6$ of the width of the edge portion of the vial 10*a* and smaller than $\sqrt{3}/3$ of the width of the edge portion of the vial 10*a* as seen in a plan view.

In the embodiment shown in the right portion of FIG. 22 (*a*), the driving unit of the vial rotating unit 700 is provided above the vial 10*a* and configured to rotate the vial 10*a* by transmitting the rotational force to the neck portion of the vial 10*a*. As shown in the right portion of FIG. 22 (*a*), the vial rotating unit 700 contains a motor 733, a torque limiter 734 and an engaging piece 732. The torque limiter 734 is coupled to the motor 733 by a first shaft 735. The engaging piece 732 is coupled to the torque limiter 734 by a second shaft 736. The engaging piece 732 engages with the neck portion of the vial 10*a*.

The motor 733 generates a rotational force. This rotational force is transmitted to the engaging piece 732 through the first shaft 735, the torque limiter 734 and the second shaft 736. Therefore, the engaging piece 732 rotates around the second shaft 736. Since the neck portion of the vial 10*a* is engaged with the engaging piece 732, the vial 10*a* also rotates around the second shaft 736 in coordination with the rotation of the engaging piece 732. In short, the first shaft 735, the torque limiter 734, the second shaft 736, the engaging piece 732 and the vial 10*a* rotates altogether by the rotational force generated by the motor 733.

While coordinating with this movement, the body 911 of the stopper 900*a* pushes out the rod 912 toward the lateral surface of the vial 10*a*. When the middle of the edge portion of the vial 10*a* is close to the front end of the rod 912, the lateral surface of the vial 10*a* does not contact with the rod 912. However as the vial 10*a* rotates and the corner portion of the vial 10*a* approaches to the front end of the rod 912, the gap between the lateral surface of the vial 10*a* and the front end of the rod 912 becomes closer. Eventually, a predetermined position in the lateral surface of the vial 10*a* hits the front end of the rod 912. Because of the torque limiter 734, the rotational force transmitted to the vial 10*a* is attenuated. Therefore, the vial 10*a* is prevented from rotating furthermore once the lateral surface of the vial 10*a* hits the rod 912. When the vial 10*a* is stopped rotating, the corner portion of the vial 10*a* is always positioned at a predetermined place, which is near the front end of the rod 912. Thereby, the transverse orientation of the vial 10*a* is physically determined.

§ 3.4.2 Second Embodiment of the Vial Orientation Determining Unit

In the embodiment shown in FIG. 22 (*b*), the vial orientation determining unit 900*b* contains a pitfall 920, which is formed by a hole. The pitfall 920 is provided on a tray 721, which contains a floor surface that contacts with the bottom surface of the vial 10*a*. The plan-view shape of the pitfall 920 corresponds to the bottom shape of the vial 10*a*, but the plan-view size of the pitfall 920 is slightly larger than the bottom shape of the vial 10*a*. It is preferable that the area of the pitfall 920 is larger than the area of the bottom surface of the vial 10*a* but at most 1.2 times larger than the area of the bottom surface of the vial 10*a*.

The vial rotating unit 700 is provided above the pitfall 920. The configuration of the vial rotating unit 700 is basically the same as the vial rotating unit 700 described above. One difference is the second shaft 736 is elongatable from the torque limiter 734 by the weight of the vial 10*a*. In other embodiments, the second shaft 736 may be biased toward the pitfall 920 so that the second shaft 736 can press the vial 10*a* toward the tray 721.

As the vial rotating unit 700 rotates the vial 10*a*, the transverse orientation of the vial 10*a* changes. When the transverse orientation of the vial 10*a* matches with the orientation of the pitfall 920, the vial 10*a* falls into the pitfall 920. In other words, when the orientation of the bottom surface of the vial 10*a* matches to the orientation of the pitfall 920, the vial 10*a* falls into the pitfall 920. Once the vial 10*a* falls into the pitfall 920, the vial 10*a* engages with the pitfall 920. Therefore, the vial 10*a* cannot rotate furthermore as long as the bottom part of the vial 10*a* is inside the pitfall 920. Thus, the corner portion of the vial 10*a* is positioned at the corner portion of the pitfall 920, which does not move. Thereby, the transverse orientation of the vial 10*a* is physically determined.

In the above-mentioned embodiments, the vial orienting unit was placed in order to adjust the orientation of the vial for its labeling. In other words, the vial orienting unit was placed near or upstream from the labeling unit. However, the vial orienting unit may be placed in other places within the medicine dispensing apparatus. For example, the vial orienting unit may be placed at a place downstream of the medicine filling unit 4. The vial orienting unit and the labeling unit are optimally placed right next to the vial discharging window 50 to label the vial filled with the medicines before dispensing the vial 10*a*. Furthermore, the vial orienting unit can be used for purposes other than labeling.

In the above-mentioned embodiments, the vials were used for the explanation purposes. However, the present invention is applicable to other kinds of containers and receptacles. Further, the present invention is also applicable to fill the container or the receptacle with tabular, capsular, granular or powder articles.

While the principles of the disclosure have been described above in connection with specific apparatuses/devices and methods, it is to be clearly understood that this description is made only by way of example and not as limitation on the scope of the invention.

The invention claimed is:

1. A medicine dispensing apparatus for dispensing medicines filled in a vial having a polygonal cross-sectional shape with a plurality of corner portions, the apparatus comprising:

a stocker that stocks the vial;

a labeling unit that labels the vial;

a vial transporting unit that transports the vial from the stocker to the labeling unit, said vial transporting unit comprises a vial erecting unit configured to place the vial in a standing position with its opening facing upward;

a first vial orienting unit that adjusts coarsely an orientation of the vial;

a second vial orienting unit that adjusts precisely the vial by obtaining information about a transverse cross-sectional shape of the vial and thereby rotating the vial around a rotational axis extending in a longitudinal direction of the vial and identifying a transverse orientation of the vial by detecting anyone of said plurality of corner portions so as to determine a starting position for labeling the vial, based at least in part on said information; and a medicine filling unit that fills the vial with the medicines.

2. The medicine dispensing apparatus of claim 1, further comprising:

a vial discharging window through which the vial is discharged out of the medicine dispensing apparatus; and a second vial transporting unit that transports the vial from the labeling unit to the medicine filling unit and that transports the vial from the medicine filling unit to the vial discharging window.

3. The medicine dispensing apparatus of claim 1, wherein the second vial orienting unit comprises at least two pressing members, where at least one of said pressing members has a surface with a shape that fits with a shape of a portion of the lateral side of the vial.

4. The medicine dispensing apparatus of claim 3, wherein the pressing members comprise:

a first arm having a surface, whose shape corresponds to a shape of an edge portion of the lateral surface of the vial; and a second arm having a surface, whose shape corresponds to a shape of the corner portion of the lateral surface of the vial.

5. The medicine dispensing apparatus of claim 3, wherein the pressing members comprise at least three arms, each of which is configured to press an edge portion of the lateral surface of the vial.

6. The medicine dispensing apparatus of claim 3, wherein the pressing members comprise at least three arms, each of which is configured to press the corner portion of the lateral surface of the vial.

7. The medicine dispensing apparatus of claim 3, wherein the pressing members comprise:

a wall; and an arm facing the wall and configured to move toward the wall, wherein the arm comprises a surface having a shape that fits with the shape of the portion of the lateral surface of the vial.

8. The medicine dispensing apparatus of claim 1, wherein after determining the starting position, the labeling unit labels the lateral surface of the vial, which is disposed between the one corner and its next adjacent corner, without any protrusion of a label into next adjacent corner or next adjacent lateral surface of the vial.

9. The medicine dispensing apparatus of claim 1, wherein the second vial orienting unit comprises a first and second rollers.

10. The medicine dispensing apparatus of claim 9, wherein the first and second rollers are aligned in tandem and placed vertically so that rotational axes of the first and second rollers are in parallel with vial's longitudinal axis.

11. The medicine dispensing apparatus of claim 1, wherein the first vial orienting unit is disposed upstream of the labeling unit.

12. The medicine dispensing apparatus of claim 1, wherein the second vial orienting unit is disposed adjacent to the labeling unit.

* * * * *